US007708057B2

(12) United States Patent
Aivalis et al.

(10) Patent No.: US 7,708,057 B2
(45) Date of Patent: May 4, 2010

(54) COILED TUBING WELLBORE DRILLING AND SURVEYING USING A THROUGH THE DRILL BIT APPARATUS

(75) Inventors: James G. Aivalis, Houston, TX (US); Harry D. Smith, Houston, TX (US)

(73) Assignee: Thrubit B.V. (NL)

( * ) Notice: Subject to any disclaimer, the term of this patent is extended or adjusted under 35 U.S.C. 154(b) by 0 days.

(21) Appl. No.: 11/680,461

(22) Filed: Sep. 11, 2007

(65) Prior Publication Data

US 2008/0066961 A1 Mar. 20, 2008

Related U.S. Application Data

(60) Provisional application No. 60/844,604, filed on Sep. 14, 2006.

(51) Int. Cl.
*E21B 19/22* (2006.01)
*E21B 19/16* (2006.01)

(52) U.S. Cl. ..... 166/77.2; 166/77.51; 166/85.1; 166/377; 166/378

(58) Field of Classification Search ..... 166/377, 166/77.2, 77.51, 85.1, 378
See application file for complete search history.

(56) References Cited

U.S. PATENT DOCUMENTS

| | | | | |
|---|---|---|---|---|
| 5,285,008 | A | 2/1994 | Sas-Jaworski et al. | |
| 6,443,247 | B1 | 9/2002 | Wardley | |
| 6,561,278 | B2 * | 5/2003 | Restarick et al. | 166/378 |
| 6,663,453 | B2 | 12/2003 | Quigley et al. | |
| 2004/0118611 | A1 | 6/2004 | Runia et al. | |
| 2005/0029017 | A1 | 2/2005 | Berkheimer et al. | |
| 2006/0000619 | A1 * | 1/2006 | Borst et al. | 166/384 |
| 2006/0118298 | A1 | 6/2006 | Millar et al. | |
| 2007/0068677 | A1 * | 3/2007 | Angman et al. | 166/377 |

* cited by examiner

*Primary Examiner*—David J Bagnell
*Assistant Examiner*—Brad Harcourt
(74) *Attorney, Agent, or Firm*—Conley Rose, P.C.

(57) ABSTRACT

A method for inserting a tool into a wellbore includes uncoiling a coiled tubing into the wellbore to a selected depth therein. When the tubing is at the selected depth, the tubing is uncoupled. A tool is inserted into the interior of the tubing. The tubing is reconnected, and the tool is moved along the interior of the tubing.

36 Claims, 21 Drawing Sheets

COILED TUBING WELLBORE DRILLING AND SURVEYING USING A THROUGH THE DRILL BIT APPARATUS

CROSS-REFERENCE TO RELATED APPLICATIONS

Priority is claimed from U.S. Provisional Application No. 60/844,604 filed on Sep. 14, 2006.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling and surveying wellbores through Earth formations. More specifically, the invention relates to methods for drilling and surveying a wellbore using coiled tubing.

2. Background Art

U.S. Patent Application Publication No. 2004/0118611 filed by Runia et al. describes methods and apparatus for drilling and surveying a wellbore in subsurface Earth formations in which a set of survey instruments is placed within a pipe or conduit used to convey a drill bit into the wellbore. The set of survey instruments is able to exit the interior of the pipe or conduit by a special tool causing a center segment of the drill bit to release, thus creating an opening for the survey instruments to leave the pipe or conduit and enter the wellbore below the bottom of the pipe or conduit.

The method and apparatus disclosed in the Runia et al. publication is intended to be used on so called "jointed" pipe, wherein a length of such pipe is made by threadedly assembling segments or "joints" of such pipe into a "string" extended into the wellbore. It is known in the art to carry out operations in a wellbore using so-called "coiled tubing." In coiled tubing operations, a reel of tubing is transported to the wellbore site. Wellbore tools of various types, including drilling tools, are affixed to the end of the coiled tubing, and the coiled tubing is unwound from the reel so as to extend into the wellbore. Coiled tubing wellbore operations have advantages such as much faster time to exchange wellbore tools by retrieving the coiled tubing from the wellbore by spooling the coiled tubing back onto the reel. Such winding is considerably faster than uncoupling the threaded connections used with conventional threadedly coupled pipe. There is a need to have wellbore drilling and surveying techniques as disclosed in the Runia et al. publication that are usable with coiled tubing.

SUMMARY OF THE INVENTION

In a method according to one aspect of the invention, a wellbore is drilled and surveyed using coiled tubing. A method according to this aspect of the invention includes unspooling a coiled tubing into a wellbore to a selected depth therein. When the tubing is at the selected depth, the tubing is uncoupled and in some embodiments a section of coiled tubing containing a latched tool is inserted into the coiled tubing. In other embodiments, the tool is inserted into the uncoupled tubing. The tubing is reconnected, and the tool is detached from the coiled tubing and is moved along the interior of the tubing.

In one embodiment, the tool causes a center drill bit section to become unlatched from the tubing. The tool is then moved at least in part into the wellbore below the portion of the drill bit remaining attached to the coiled tubing string. The entire drill bit or drilling assembly may be released in another embodiment.

Other aspects and advantages of the invention will be apparent from the following description and the appended claims.

DETAILED DESCRIPTION

Figure 1:
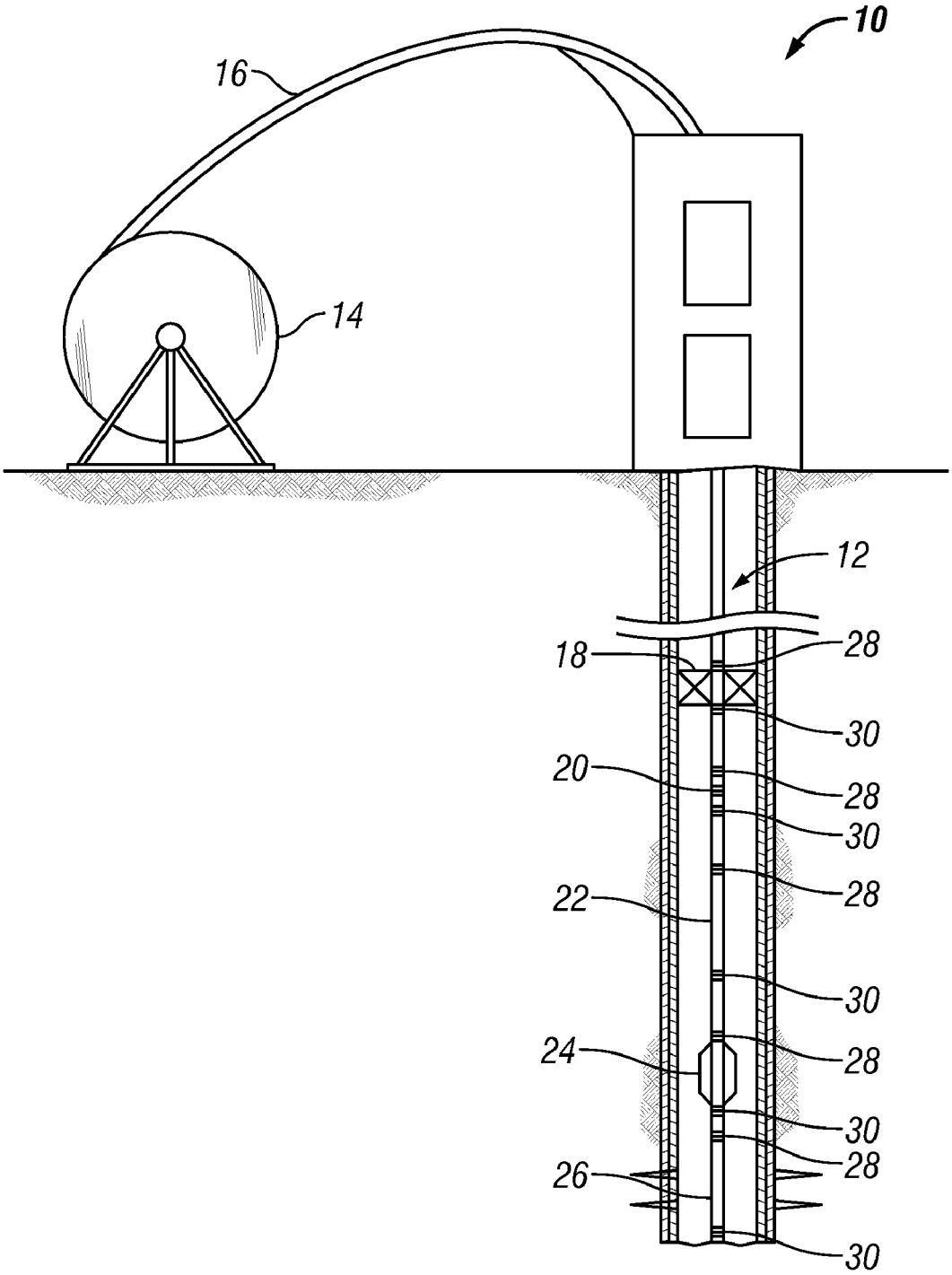
FIG. 1 is a schematic partially cross-sectional side view of an apparatus embodying principles of the present invention.

The principle of inserting various types of wellbore instruments into a coiled tubing according to the present invention may use, in some embodiments, a method and apparatus disclosed in U.S. Pat. No. 6,561,278 to Restarick et al., incorporated herein by reference. FIG. 1 shows an apparatus 10 which embodies principles of such apparatus and methods. In the following description of the apparatus 10, and with respect to other apparatus and methods described herein, directional terms, such as "above", "below", "upper", "lower", etc., are used only for convenience in referring to the accompanying drawings and are not intended to limit the scope of the invention to any specific relative placement of the various components described herein. Additionally, it is to be understood that the various embodiments described herein may be used in wellbores having various orientations, such as inclined, inverted, horizontal, vertical, etc., and in various configurations, without exceeding the scope of what has been invented.

In the apparatus 10, a continuous tubing string 12 known in the art is deployed into a wellbore by unwinding it from a reel 14. Since the tubing string 12 is initially wrapped on the reel 14, such continuous tubing strings are commonly referred to as "coiled tubing" strings. As used herein, the term "continuous" means that the tubing string is deployed substantially continuously into a wellbore, allowing for some interruptions to interconnect certain tool assemblies therein, as opposed to the manner in which segmented or "jointed" tubing is deployed into a wellbore by threadedly coupling together individual "joints" or "stands" limited in length by the height of a rig supporting structure ("derrick") at the wellbore.

The vast majority of the tubing string 12 consists of tubing 16. The tubing 16 may be made of a metallic material, such as steel, or it may be made of a nonmetallic material, such as a composite material, including, for example, fiber reinforced plastic. As described below connectors in the tubing string permit tool assemblies to be inserted into the interior of the tubing string 12 for movement to the bottom of the tubing string 12 and/or beyond the bottom thereof.

In the apparatus 10, wellbore tool assemblies 18 (a packer), 20 (a valve), 22 (a sensor apparatus), 24 (a wellbore screen) and 26 (a spacer or blast joint) can be interconnected in the tubing string 12 without requiring splicing of the tubing 16 at the wellbore, and without requiring the tool assemblies to be wrapped on the reel 14. In the present invention, connectors 28, 30 are provided in the tubing string 12 above and below, respectively, each of the tool assemblies 18, 20, 22, 24, 26. These connectors 28, 30 are included into the tubing string 12 prior to, or as, it is being wrapped on the reel 14, with each connector's position in the tubing string 12 on the reel 14 corresponding to a desired location for the respective tool assembly in the wellbore.

The tool assemblies 18, 20, 22, 24, 26 may also be various forms of wellbore logging (formation evaluation) and drilling sensors, including but not limited to acoustic sensors, natural or induced gamma radiation sensors, electromagnetic and/or galvanic resistivity sensors, gamma-gamma (photon backscatter) density sensors, neutron porosity and/or capture cross section sensors, formation fluid testers, mechanical stress sensors, mechanical properties sensors or any other type of wellbore logging and formation evaluation sensor known in the art. Such sensors may include batteries (not shown) or turbine generators (not shown) for electrical power. Signals detected by the various sensors may be stored locally in a suitable recording medium (not shown) in each tool assembly, or may be communicated to the Earth's surface using suitable telemetry, such as mud pulse telemetry, electromagnetic telemetry, acoustic telemetry, electrical telemetry along a cable inside or outside the tubing string 12 or in cases where the tubing string 12 is made from a composite material having electrical lines therein, as will be explained in more detail below, telemetry can be applied to the electrical lines for detection and decoding at the Earth's surface. Signals, such as operating commands, or data, may also be communicated from the Earth's surface to the tool assemblies in the well using any known type of telemetry.

The connectors 28, 30 are placed in the tubing string 12 at appropriate positions, so that when the tool assemblies 18, 20, 22, 24, 26 are interconnected to the connectors 28, 30 and the tubing string 12 is deployed into the wellbore, the tool assemblies 18, 20, 22, 24, 26 will be disposed at their respective desired locations in the wellbore. In the case of wellbore logging sensors, the coiled tubing may be extended into the wellbore and/or retracted from the wellbore in order to make a record of the various sensor measurements with respect to depth in the wellbore.

The tubing string 12 with the connectors 28, 30 therein is wrapped on the reel 14 prior to being transported to the wellbore. At the wellbore, the tool assemblies 18, 20, 22, 24, 26 are interconnected between the connectors 28, 30 as the tubing string 12 is deployed into the wellbore from the reel 14. In this manner, the tool assemblies 18, 20, 22, 24, 26 do not have to be wrapped on the reel 14 or be transported around the gooseneck (G in FIG. 1A).

Figure 1A:
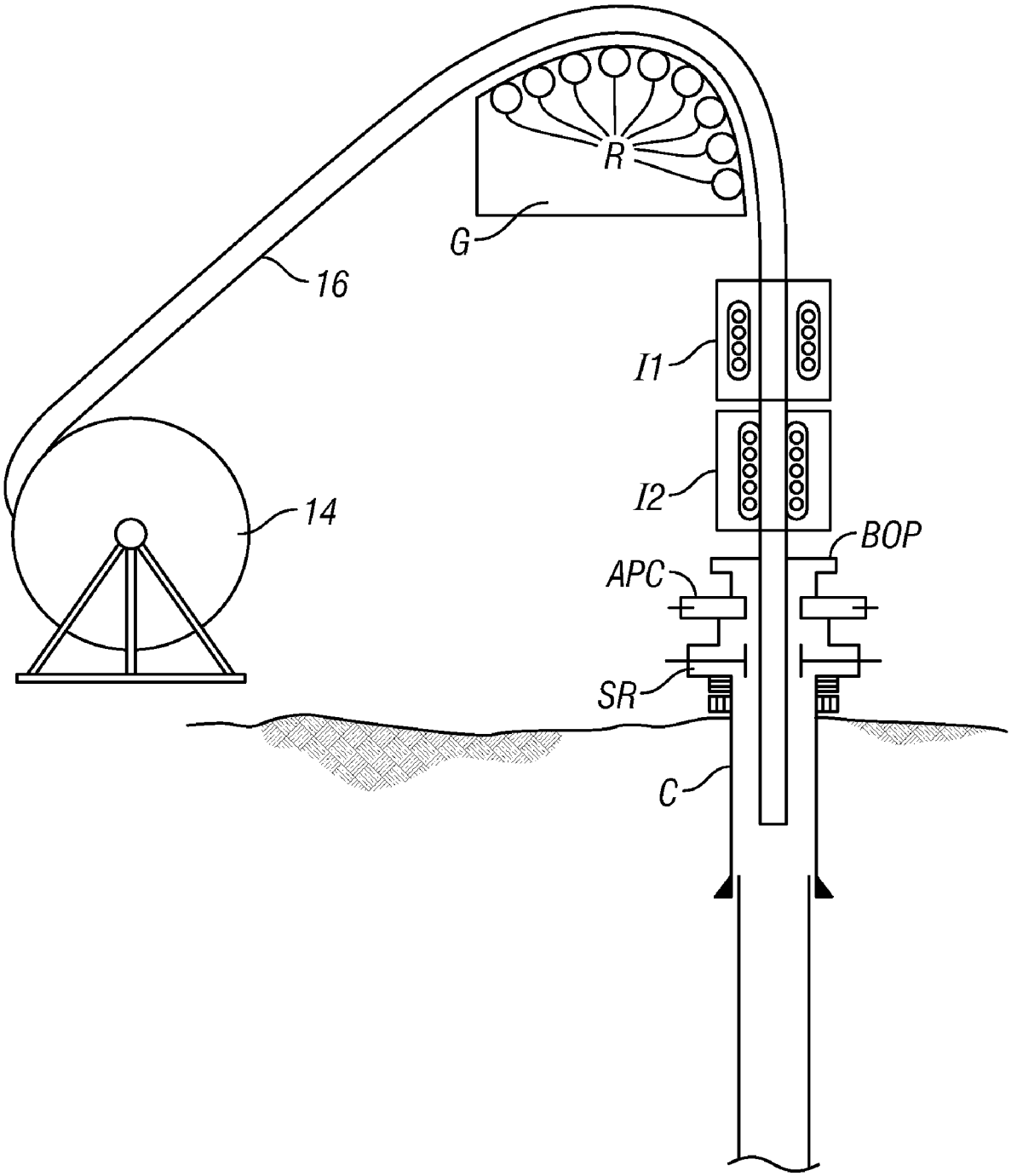
FIG. 1A shows elements of a well pressure control system and coiled tubing operating devices in more detail.

Equipment usually used with coiled tubing in wellbore operations is shown schematically in FIG. 1A. The wellbore includes at least a surface casing C cemented therein. The uppermost end of the casing C typically will be coupled to a blowout preventer BOP or similar wellbore fluid pressure control device. The blowout preventer BOP includes "shear rams" SR or similar device capable of closing the wellbore by shearing through the tubing 16 or other device disposed within the opening of the blowout preventer BOP. The blowout preventer BOP may include an annular pressure control device APC that seals around the exterior of the tubing 16, such as one sold under the trademark HYDRIL, which is a registered trademark of Hydril Company, Houston, Tex. The tubing 16 is moved into and out of the wellbore by one or more tubing injectors 11, 12 of types well known in the art. The tubing injectors 11, 12 may have different diameters if the tubing includes upset diameter elements therein, such as the connectors (28, 30 in FIG. 1). The tubing 16 is gradually bent to extend along the longitudinal axis of the wellbore by passing over a gooseneck G, which may include a plurality of rollers R or the like to enable to tubing 16 to move over the gooseneck G with minimal friction.

Figure 2:
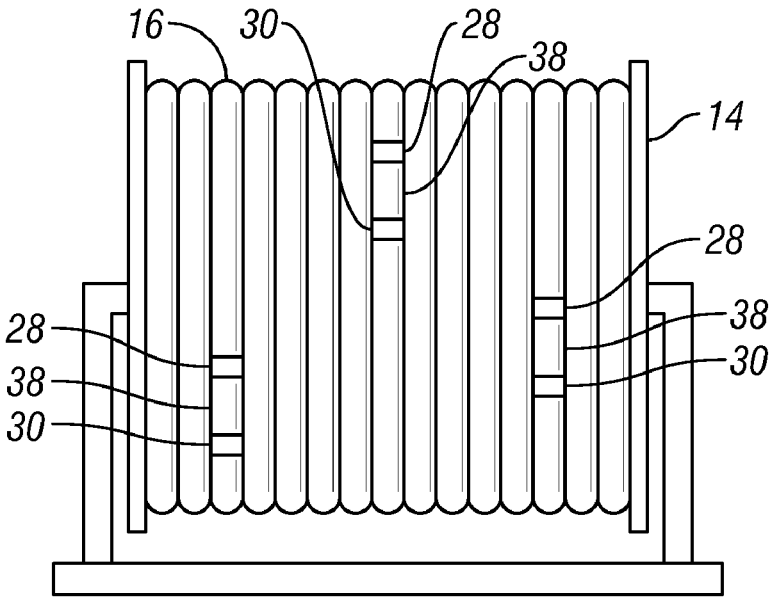
FIG. 2 is an elevational view of a tubing reel utilized in the apparatus of FIG. 1.

Referring to FIG. 2, a view of the reel 14 is shown in which the connectors 28, 30 are wrapped with the tubing 16 on the reel 14. In the view of FIG. 2 it may be clearly seen that the connectors 28, 30 are interconnected to the tubing 16 prior to the tubing 16 being wrapped on the reel 14. As described above, the connectors 28, 30 are positioned to correspond to desired locations of particular tool assemblies in a wellbore Placeholders 38 can be used to substitute for the respective tool assemblies between the connectors 28, 30 when the tubing 16 is wrapped on the reel 14.

Figure 3:
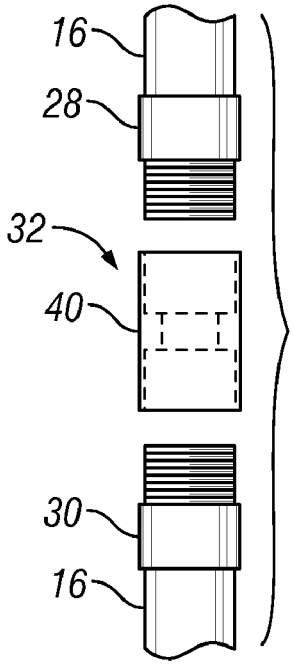
FIGS. 3-5 are side elevational views of alternate connector systems utilized in the apparatus of FIG. 1.
Figure 4:
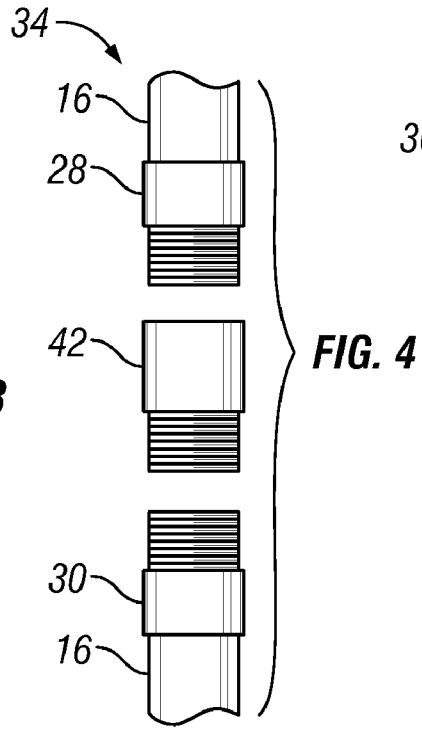
Figure 5:
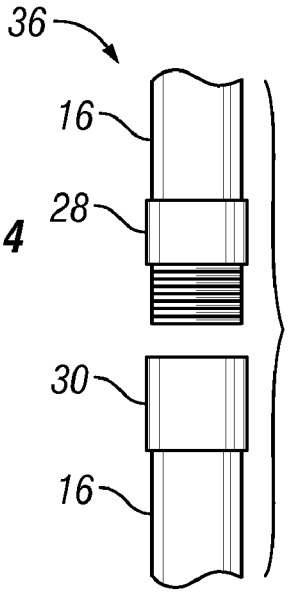

Referring to FIGS. 3-5, various alternate connector systems 32, 34, 36 are representatively illustrated. In the system 32 depicted in FIG. 3, both of the connectors 28, 30 are male-threaded, and so a placeholder 40 used to connect the connectors 28, 30 together while the tubing string 16 is on the reel 14 has opposing female threads. In some embodiments, a will be explained in more detail below with reference to FIG. 10A, a segment 159 of tubing with a logging tool 160 attached or latched to the inside is inserted into the tubing string 12 when the connectors (28, 30 in FIG. 1) are uncoupled. Other embodiments may provide that the tool assembly is inserted directly into the interior of the tubing string 12 directly without the need to an additional segment 159 of tubing. In the system 34 depicted in FIG. 4, the connector 28 has male threads, the connector 30 has female threads, and so a placeholder 42 has both male and female threads. In the system 36 depicted in FIG. 5, no placeholder is used. Instead, the male-threaded connector 28 is directly connected to the female-threaded connector 30 when the tubing 16 is wrapped on the reel 14.

Thus, it may be observed that a variety of methods may be used to provide the connectors 28, 30 in the tubing string 12. Of course, it is not necessary for the connectors 28, 30 to be threaded, or for any particular type of connector to be used. Any connector may be used in the apparatus 10, without exceeding the scope of this invention. If the tubing segment (159 in FIG. 10A), connectors (28, 30 in FIG. 1) and tool assembly 160 introduce an upset in the tubing diameter, it may be advantageous to utilize two injector assemblies (11, 12 in FIG. 1A) or one injector assembly capable of accommodating tubing with different diameters. See, for example, Tubel, U.S. Pat. No. 6,082,454 and/or Rosine, U.S. Pat. No. 6,834,734 to facilitate movement of the tubing string 12. It may also be possible to use, as an alternative to the coupling technique described with reference to FIG. 1, a fusion bonding method, as practiced by TubeFuse Technologies Ltd., Kings Park, Fifth Avenue, Team Valley, Gateshead, Tyne and Wear, United Kingdom NE11 0AF. Alternatively, the connectors (28, 30 in FIG. 1) may be made from high strength material such as titanium or other high strength alloy, such that the connectors 28, 30 and/or tubing segment (159 in FIG. 10A) do not introduce upsets into the tubing string 12 diameter. Still another alternative is to join the tubing segments using a so-called "roll on" or "crimp on" connector. Such connectors include a profiled insert with external seals that fits into the open ends of separated tubing string. A crimping or rolling device then compresses the tubing onto the connector to seal the ends and to provide mechanical coupling between the tubing ends. One such connector is sold by Schlumberger Technology Corporation, Sugar Land, Tex. and is identified as a "roll-on" connector.

Figure 6:
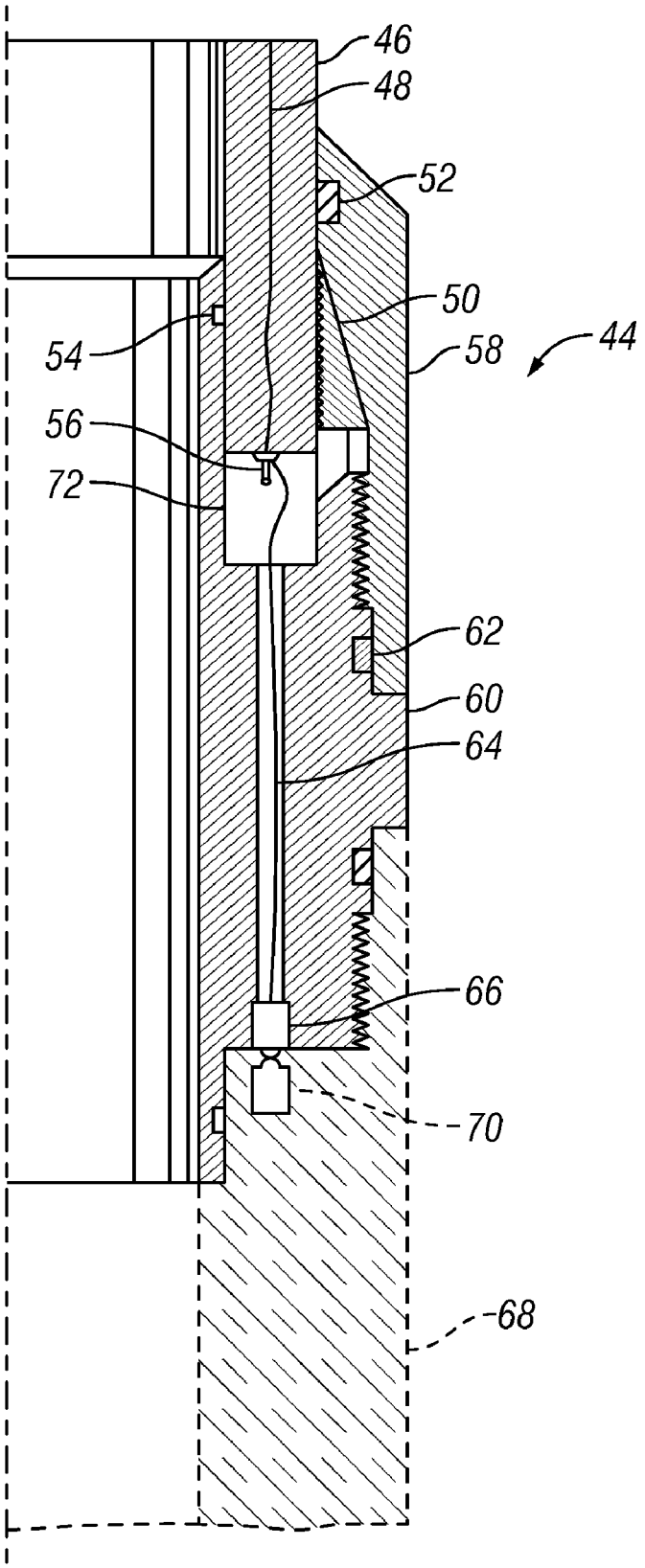
FIG. 6 is a quarter-sectional view of a first connector.

Referring to FIG. 6, another embodiment of a connector 44 is shown. The connector 44 may be used in substitution of the connector 28 or 30 in the apparatus 10, or it may be used in other apparatus. The connector 44 is configured for use with a composite tubing 46, which has one or more lines 48 embedded in a sidewall thereof. A slip, ferrule or serrated wedge 50, or multiple ones of these, is used to grip an exterior surface of the tubing 46. The slip 50 is biased into gripping engagement with the tubing 46 by tightening a sleeve 58 onto a housing 60. A seal 52 seals between the exterior surface of the tubing 46 and the sleeve 58. Another seal 54 seals between an interior surface of the tubing 46 and the housing 60. A further seal 62 seals between the sleeve 58 and the housing 60. In this manner, an end of the tubing 46 extending into the connector 44 is isolated from exposure to fluids inside and outside the connector. A barb 56 or other electrically conductive member is inserted into the end of the tubing 46, 50 that the barb 56 contacts the line 48. A potting compound 72, such as an epoxy, may be used about the end of the tubing 46 and the barb 56 to prevent the barb 56 from dislodging from the tubing 46 and/or to provide additional sealing for the electrical connection. Another conductor 64 extends from the barb 56 through the housing 60 to an electrical contact 66. The barb 56, conductor 64 and contact 66 thus provide a means of transmitting electrical signals and/or power from the line 48 to the lower end of the connector 44. Shown in dashed lines in FIG. 6 is a mating connector or tool assembly 68, which includes another electrical contact 70 for transmitting the signals/power from the contact 66 to the connector or tool assembly 68.

Although the line 48 has been described above as being an electrical line, it will be readily appreciated that modifications may be made to the connector 44 to accommodate other types of lines. For example, the line 48 could be a fiber optic line, in which case a fiber optic coupling may be used in place of the contact 66, or the line 48 could be a hydraulic line, in which case a hydraulic coupling may be used in place of the contact 66. In addition, the line 48 could be used for various purposes, such as communication, chemical injection, electrical or hydraulic power, monitoring of downhole equipment and processes, and a control line for, e.g., a safety valve, etc. Of course, any number of lines 48 may be used with the connector 44, without exceeding the scope of what has been invented.

Figure 7:
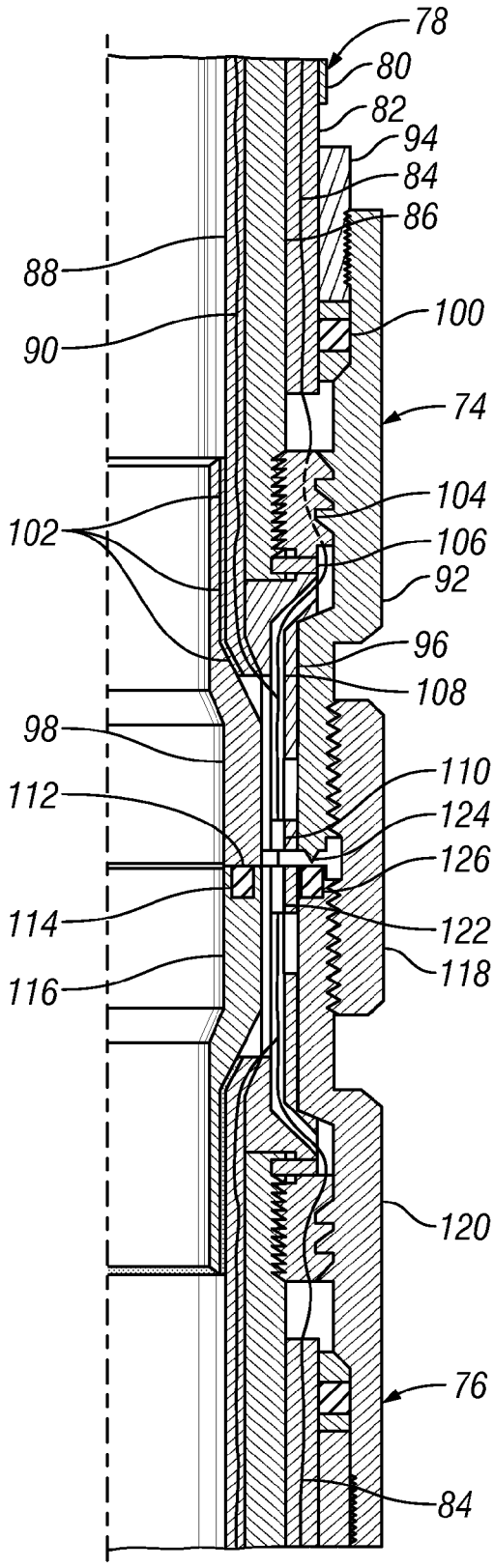
FIG. 7 is a quarter-sectional view of a second connector.

Referring to FIG. 7, an upper connector 74 and a lower connector 76 embodying principles of the present invention are shown. These connectors 74, 76 may be used in substitution of the connectors 28, 30 in the apparatus 10 of FIG. 1, or they may be used in any other apparatus.

The connectors 74, 76 are designed for use with a composite tubing 78. The tubing 78 has an outer wear layer 80, a layer 82 in which one or more lines 84 is embedded, a structural layer 86 and an inner flow tube or seal layer 88. This tubing 78 may be a composite coiled tubing sold under the trademark FIBERSPAR, which is a registered trademark of Fiberspar Corporation, Northwoods Industrial Park West, 12239 FM 529, Houston, Tex. 77041. One or more lines 90 may also be embedded in the seal layer 88.

The wear layer 80 provides abrasion resistance to the tubing 78. The structural layer 86 provides strength to the tubing 78. The layers 82, 88 isolate the structural layer 86 from contact with fluids internal and external to the tubing 78, and provide sealed pathways for the lines 84, 90 in a sidewall of the tubing 78. Thus, if the lines 84, 90 are electrical conductors, the layers 82, 88 provide insulation for the lines. Of course, any type of line may be used for the lines 84, 90, without exceeding the scope of the invention.

The upper connector 74 includes an outer housing 92, a sleeve 94 threaded into the housing 92, a mandrel 96 and an inner seal sleeve 98. The upper connector 74 is sealed to an end of the tubing 78 extending into the upper connector 74 by means of a seal assembly 100, which is compressed between the sleeve 94 and the housing 92, and by means of sealing material 102 carried externally on the inner seal sleeve 98.

The mandrel 96 grips the structural layer 86 with multiple collets 104, only one of which is visible in FIG. 7, having teeth formed on inner surfaces thereof. Multiple inclined surfaces are formed externally on each of the collets 104, and these inclined surfaces cooperate with similar inclined surfaces formed internally on the housing 92 to bias the collets 104 inward into engagement with the structural layer 86. A pin 106 prevents relative rotation between the mandrel 96 and the tubing 78.

The line 84 extends outward from the layer 82 and into the upper connector 74. The line 84 passes between the collets 104 and into a passage 108 formed through the mandrel 96. At a lower end of the mandrel 96, the line 84 is connected to a line connector 110. If the line 90 is provided in the seal layer 88, the line 90 may also extend through the passage 108 in the mandrel 96 to the line connector 110, or to another line connector.

The line connector 110 is depicted as being a pin-type connector, but it may be a contact, such as the contact 66 described above, or it may be any other type of connector. For example, if the lines 84, 90 are fiber optic or hydraulic lines, then the line connector 110 may be a fiber optic or hydraulic coupling, respectively.

When the connectors 74, 76 are connected to each other, an annular projection 112 formed on a lower end of the inner seal sleeve 98 initially sealingly engages an annular seal 114 carried on an upper end of an inner sleeve 116 of the lower connector 76. Further tightening of a threaded collar 118 between the housing 92 and a housing 120 of the lower connector 76 eventually brings the line connector 110 into operative engagement with a mating line connector 122 (shown in FIG. 7 as a socket-type connector) in the lower connector 76, and then brings an annular projection 124 into sealing engagement with an annular seal 126 carried on an upper end of the housing 120. The seals 114, 126 isolate the line connectors 110, 122 (and the interiors of the connectors 74, 76) from fluid internal and external to the connectors.

Since the lower connector 76 is otherwise similarly configured to the upper connector 74, it will not be further described herein. Note that both of the connectors 74, 76 may be connected to tool assemblies, such as the tool assemblies 18, 20, 22, 24, 26, so that connections to lines may be made on either side of each of the tool assemblies. Thus, the lines 84, 90 may extend through each of the tool assemblies from a connector above the tool assembly to a connector below the tool assembly. This functionality is also provided by the connector 44 described above.

Figure 8:
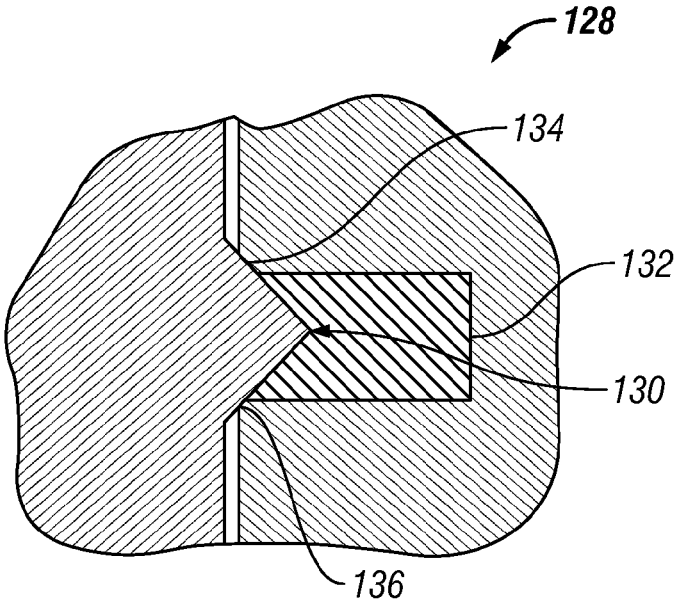
FIG. 8 is an enlarged cross-sectional view of an alternate seal structure for use with the second connector.

Referring to FIG. 8, an alternate seal configuration 128 is representatively illustrated. The seal configuration 128 may be used in place of either the projection 112 and seal 114, or the projection 124 and seal 126, of the connectors 74, 76.

The seal configuration 128 includes an annular projection 130 and an annular seal 132. However, the projection 130 and seal 132 are configured so that the projection 130 contacts shoulders 134, 136 to either side of the seal 132. This contact prevents extrusion of the seal 132 due to pressure, and also provides metal-to-metal seals between the projection 130 and the shoulders 134, 136.

Figure 9:
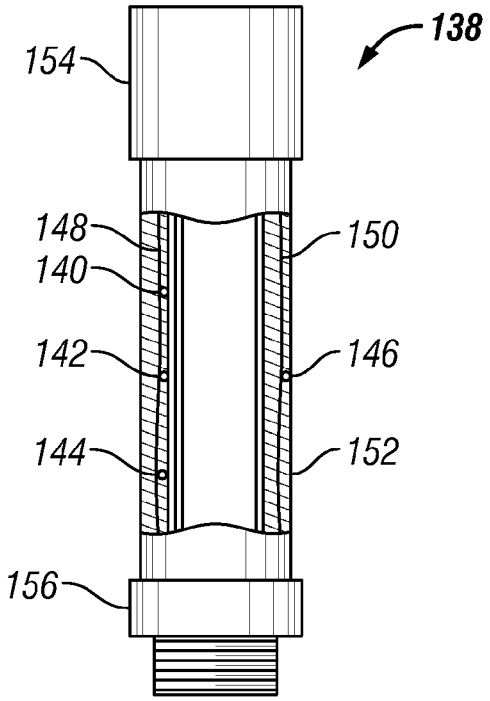
FIG. 9 is a partially cross-sectional view of a sensor apparatus embodying principles of the present invention.

Referring to FIG. 9, an example is shown of a tool assembly 138 which may be interconnected in a continuous tubing string. The tool assembly 138 is a sensor apparatus. It includes sensors 140, 142, 144, 146 interconnected to lines 148, 150 embedded in a sidewall material of a tubular body 152 of the tool assembly 138.

The sensors 140, 142, 144, 146 are also embedded in the sidewall material of the body 152. The sensors 140, 142, 144 sense parameters internal to the body 152, and the sensor 146 senses one or more parameter external to the body 152. Any type of sensor may be used for any of the sensors 140, 142, 144, 146. For example, pressure and temperature sensors may be used. It would be particularly advantageous to use a combination of types of sensors for the sensors 140, 142, 144, 146 which would allow computation of values, such as multiple phase flow rates through the tool assembly 138.

As another example, it would be advantageous to use a seismic sensor for one or more of the sensors 140, 142, 144, 146. This would make available seismic information previously unobtainable from the interior of a sidewall of a tubing string.

Note that when using certain types of sensors, the sidewall material is preferably a nonmetallic composite material, but other types of materials may be used in keeping with the principles of the invention. In particular, the body 152 could be a section of composite tubing, in which the sensors 140, 142, 144, 146 have been installed and connected to the lines 148, 150.

The lines 148, 150 may be any type of line, including electrical, hydraulic, fiber optic, etc. Additional lines (not shown in FIG. 9) may extend through or into the tool assembly 138. Connectors 154, 156 permit the tool assembly 138 to be conveniently interconnected in a tubing string. For example, the connector 76 described above may be used for the connector 154, and the connector 74 described above may be used for the connector 156. Via the connectors 154, 156, the lines 148, 150 are connected to lines extending through tubing or other tool assemblies attached to each end of the tool assembly 138.

Figure 10:
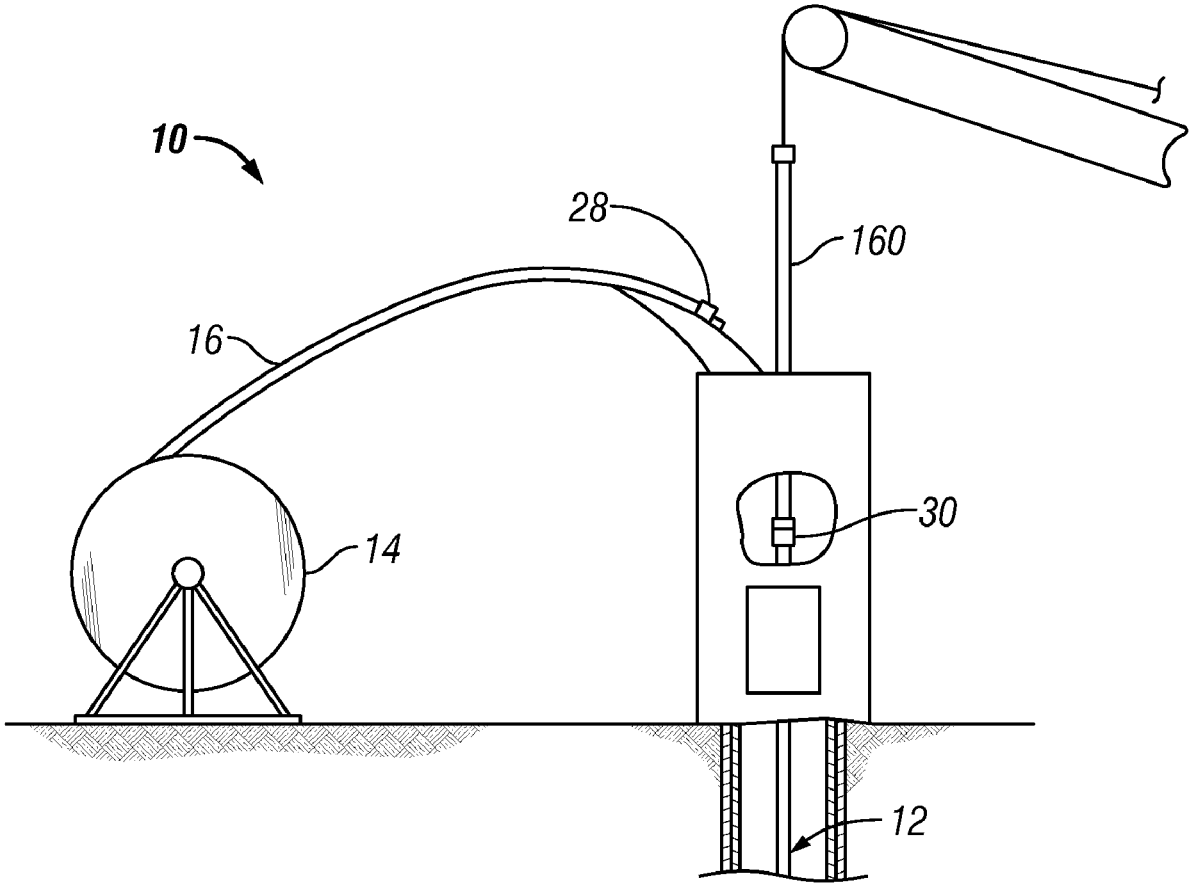
FIG. 10 is a schematic partially cross-sectional side view of a variation of the apparatus of FIG. 1.

Referring to FIG. 10, the apparatus 10 is shown wherein a tool assembly 160 is being inserted into the interior of the tubing string 12. The tool assembly 160 may be too long, too rigid, or too large in diameter to be wrapped on the reel 14 with the tubing 16. In the present embodiment, the tool assembly 160 may be a set of wellbore logging or formation evaluation sensors disposed in a single housing adapted to traverse the interior of the tubing string 12, and as will be further explained below with reference to FIGS. 11 through 15, in some embodiments may at least partially exit through a special opening in a drill bit disposed at the end of the tubing string 12. The sensors measure one or more parameters related to the ambient environment inside or outside the tubing string 12, and may include, for example, gamma radiation, density, neutron capture cross section, acoustic velocity, pressure, temperature, electrical resistivity and any other parameter of interest related to the tubing string 12, the wellbore or the surrounding subsurface formations.

The connectors 28, 30 are separated, and a placeholder 38 (if used) is removed prior to inserting the tool assembly 160 into interior of the tubing string 12. The tool assembly 160, and in some embodiments inside tubing segment (159 in FIG. 10A), may be lifted by a cable supported by a crane, mast unit or derrick known in the art for supporting sheave units used with electrical wireline or slickline deployment systems. The tool assembly 160 inside the tubing segment (159 in FIG. 10A) in some embodiments is inserted into the tubing string 12, the lower connector 30 is reconnected to the upper connector 28, and the tubing string 12 is extended into the wellbore. As described above, the connectors 28, 30 are provided already connected to the tubing 16 when the tubing 16 is wrapped on the reel 14 and transported to the wellbore. Thus, a long tool assembly may be inserted into the interior of the tubing string without the need to wrap in on the reel 14 or go around the gooseneck (G in FIG. 1A). The tool assembly 160 may include a latch or similar releasable restraining device (not shown) to hold the tool assembly 160 in its longitudinal position in the tubing string 12, and in some embodiments tubing segment 159 inserted into the tubing string 12, until which time it is desired to move the tool assembly 160 downward in the tubing string 12. Such latch may be released by pumping a small release tool or the like through the interior of the tubing string 12, inserted at the surface end of the tubing string 12 at the reel 14. Other examples of releasing devices are described below with reference to FIG. 10A.

Figure 10A:
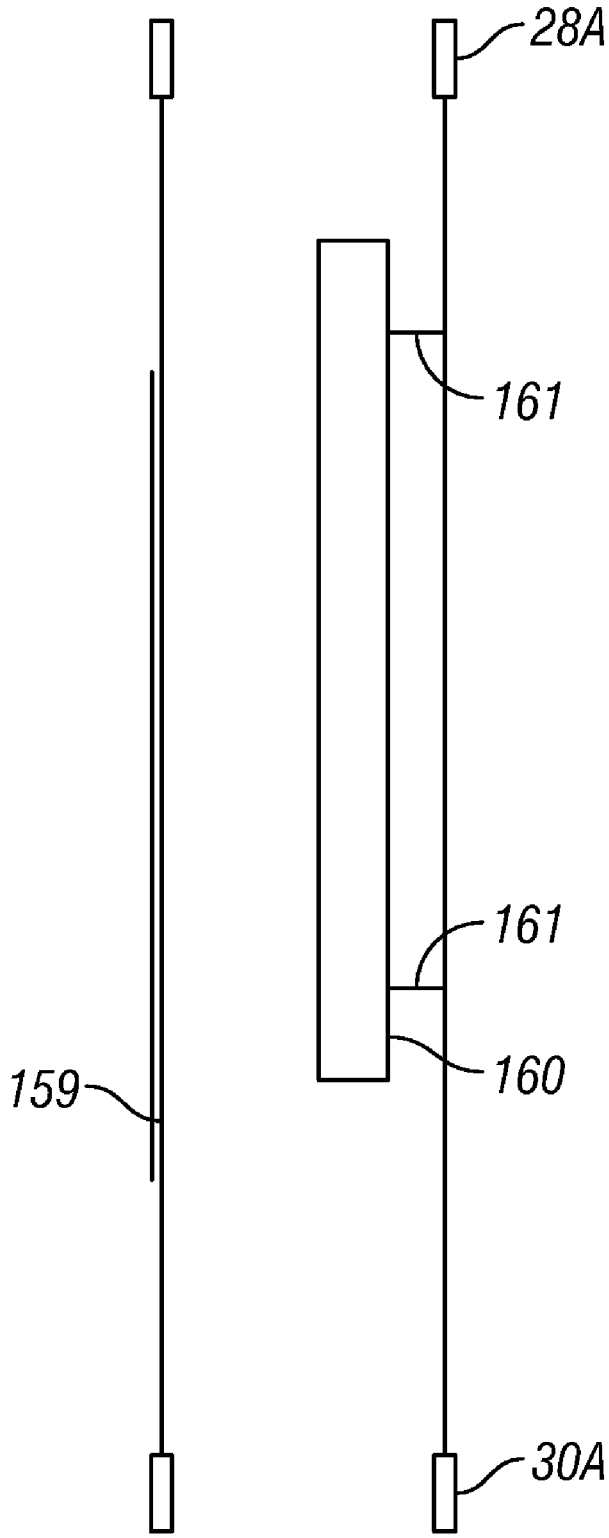
FIG. 10A shows another embodiment of tool assembly in a segment of tubing.

In FIG. 10A, some embodiments of a tool assembly 160 may provide that the tool assembly 160 is initially disposed in an insertable segment 159 of tubing. The insertable segment 159 may include connectors 28A, 30A at its longitudinal ends such that the segment 159 may be coupled to the tubing string (12 in FIG. 10) substantially as connecting together the upper and lower ends of the separated tubing string in other embodiments. The tool assembly 160 may be coupled to the interior of the segment 159 by one or more types of latch 161. The latch 161 in this embodiment and on other embodiments may be operated by any means known in the art, including but not limited to, for example, "pigging", fluid pressure, or electromagnetic or other signal from outside the tubing string 12.

Figure 25:
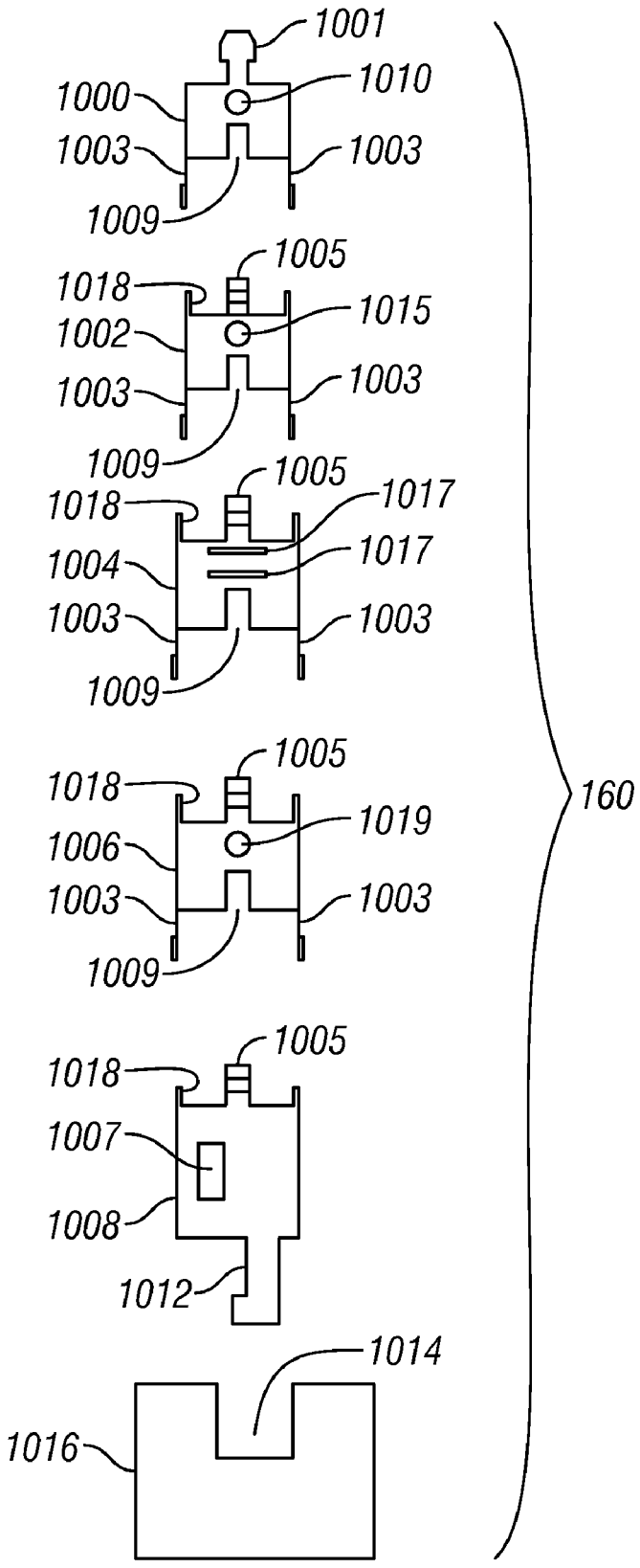
FIG. 25 shows an example of a tool assembly that can be assembled from a plurality of housing segments.

Referring to FIG. 25, in some embodiments, the tool assembly 160 may consist of a plurality of housing segments, shown generally at 1000, 1002, 1004, 1006 and 1008 having longitudinal dimension short enough and/or being flexible enough to enable movement of the segments inside the tubing string (12 in FIG. 10) while it is still on the reel (14 in FIG. 10). The housing segments 1000, 1002, 1004, 1006, 1008 may be made from steel, titanium or other high strength metal, or from fiber reinforced plastic, for example. The housing segments, when moved into contact with each other may make electrical connection between them using a submersible electrical connector such as one sold by Kemlon Products and Development, Houston, Tex. The male portions of such connectors are shown at 1005 at the top of each of housing segments 1008, 1006, 1004 and 1002. Female portions of such connectors are shown at 1009 at the bottom of housing segments 1000, 1002, 1004 and 1006. In the present embodiment, the uppermost housing segment 1000, which is the last to be inserted into the tubing string (12 in FIG. 1) if inserted by opening the tubing string at or near the Earth's surface, may include a power supply and signal processing and storage elements (not shown separately), and in some embodiments a gamma radiation sensor or spectral gamma radiation sensor 1010. The uppermost housing segment 1000 may also include a fishing neck 1001 at the upper end thereof to enable retrieval of all or part of the tool assembly 160 using slickline or wireline passed through the tubing string (12 in FIG. 1). The tool assembly 160 may also be retrieved by reverse pumping fluid into the bottom of the tubing string (12 in FIG. 1). The housing segments 1000, 1002, 1004, 1006 may each be coupled to the adjacent, lower housing segment 1002, 104, 1006, 1008 in the tool assembly 160 when contacted with such housing segment by spring loaded collets 1003 extending from the bottom of each such housing segment 1000, 1002, 1004, 1006 to be joined. The upper portion of each housing segment to be joined by the collets 1003 from the housing segment above may include an internal groove on an upper shoulder 1018 to receive and latch the collets 1003.

The second tool housing segment 1002 may include a radiation source, sensors and detection circuitry, for example, for a neutron porosity sensing device 1015. Compensated neutron devices are described, for example in U.S. Pat. No. 4,035,639 issued to Boutemy et al., incorporated herein by reference.

The next housing segment 1004 may include acoustic transducers 1017 for making various measurements of acoustic properties of the Earth formations penetrated by the wellbore. The next housing segment 1006 may include a gamma radiation backscatter density sensor 1019 that typically includes a gamma radiation source and two spaced apart gamma radiation detectors. Some density sensors may also detect photoelectric effect to provide an indication of the mineral composition of the Earth formations surrounding the wellbore. The next housing segment 1008 may include antennas 1007 and corresponding circuitry (not shown separately) for making electromagnetic induction conductivity measurements of the Earth's formations surrounding the wellbore. The order in which the segments are assembled as shown in FIG. 25 is only an illustration of one possible arrangement of sensors and is not a limit on the scope of this aspect of the invention.

To deploy such a tool assembly 160 as shown in FIG. 25, the housing segments 1008, 1006, 1004, 1002, 1000 may be inserted into the interior of the tubing string (12 in FIG. 1) one at a time at the surface end of the reel (14 in FIG. 1). Fluid may then be pumped through the interior of the tubing string (12 in FIG. 1) to move the housing segments 1008, 1006, 1004, 1002, 1000 in the direction of the bottom end of the tubing string (12 in FIG. 1). A restriction, latch, muleshoe sub or similar device 1016 may be disposed at a selected position along the tubing string (12 in FIG. 1), one such position for example, as explained further below with reference to FIG. 18. When the housing segments, starting with segment 1008, reach the device 1016, a key 1012 on the lower segment 1008 may seat in a corresponding opening 1014 in the device 1016. As each successive segment 1006, 1004, 1002, 1000 reaches the upper end of the succeeding segment in the tool assembly 160, the collets 1003 will latch in the corresponding groove 1018 in the next housing segment. When the last housing segment 1000 reaches the second housing segment 1002 the tool assembly 160 will be fully assembled.

As an alternative to using the submersible electrical connectors 1005, 1009 shown in FIG. 25, only a mechanical connection between segments, such as collets 1003 and grooves 1004, may be used. Sensor and other instrument signals and/or electrical power may be transferable between the housing segments using electromagnetic inductive couplings. See, for example, Veneruso, U.S. Pat. No. 5,521,592 for one implementation of an electromagnetic coupling. The assembled tool assembly 160 may then be operated in its ordinary manner, including for example, making a record of parameter measurements as the tubing string (12 in FIG. 1) is extended further into the wellbore, including during additional drilling of the wellbore, and/or as the tubing string (12 in FIG. 1) is withdrawn from the wellbore. Such operation may take place entirely within the tubing string (12 in FIG. 1) as well as by extending the tool assembly 160 part or all the way out of the bottom of the tubing string (12 in FIG. 1) in a manner to be further explained below.

Figure 11:
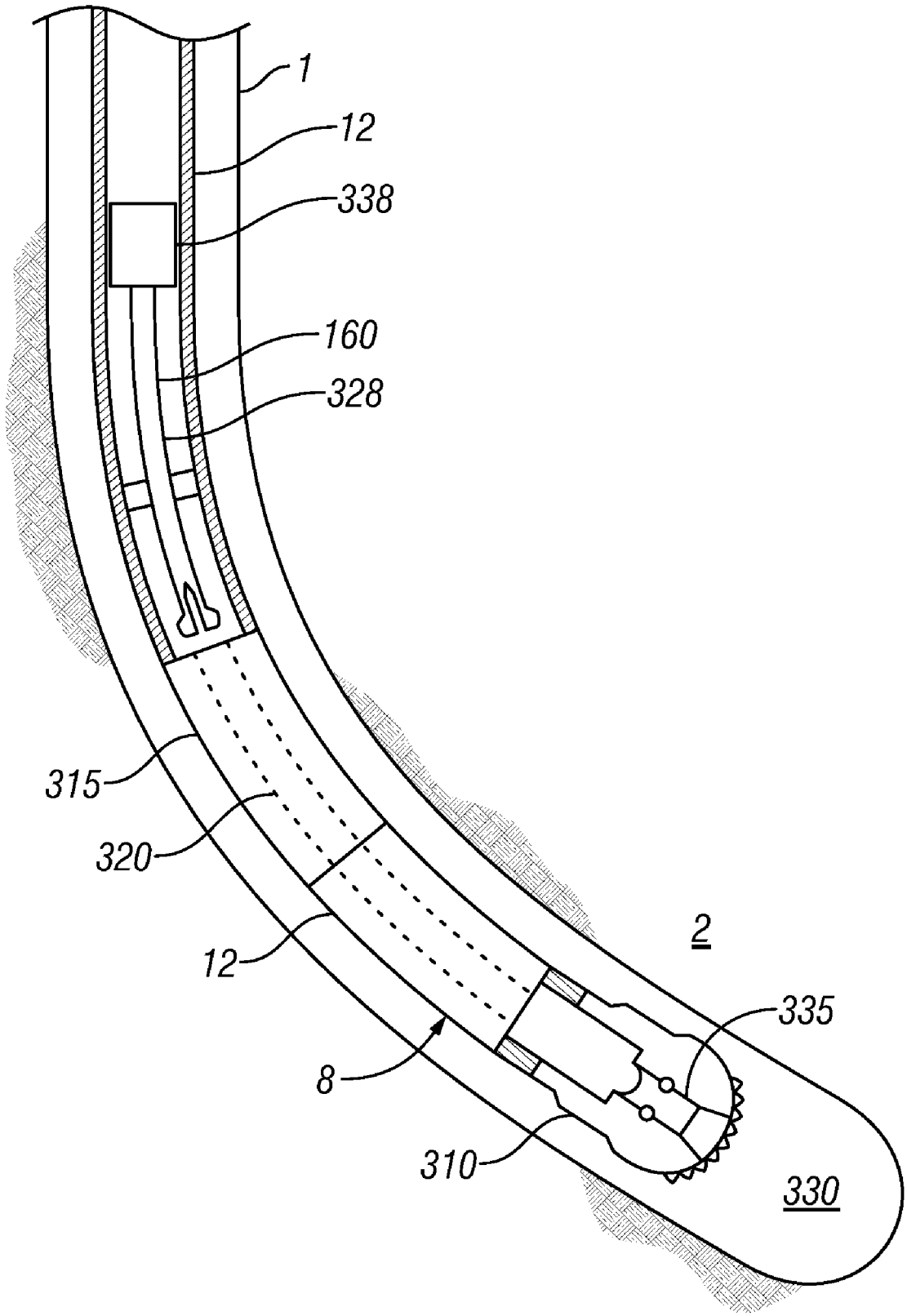
FIG. 11 shows a schematic overview of an embodiment of a through the bit system.

The description which follows is related to a method and device shown in U.S. Patent Application Publication No. 2004/0118611 filed by Runia et al. and incorporated herein by reference. Such method and apparatus as disclosed in the '611 publication is described therein as being used in a tubing string that is assembled from threadedly coupled tubing segments. In the invention, such method and apparatus has been adapted to be used, in some embodiments, with a tool assembly 160 disposed inside a coiled tubing string 12 as set forth herein. Referring to FIG. 11, the wellbore 1 extends from the Earth's surface into a subsurface Earth formation 2. The wellbore 1 is shown as deviated from vertical, wherein the curvature thereof shown in the FIG. 11 has been exaggerated for the sake of clarity. It is contemplated that the present invention will have particular advantages for use in such deviated wellbores, however the deviation of the wellbore is not a limit on the scope of the invention.

At least the lower part of the wellbore 1 that is shown in FIG. 11 may be formed by the operation of certain components coupled to the lower end of the tubing string 12. The components coupled to the lower end of the tubing string 12 are collectively referred to as a "bottom hole assembly" 8, which includes a drill bit 310, a drill steering system 312 and a surveying system 315. The bottom hole assembly 8 can include a passage 320 forming part of a passageway for the tool assembly 160, which may be disposed between a first position 328 in the interior of the tubing string 12, above the bottom hole assembly 8, and a second position 330 inside the wellbore 1 below the tubing string 12, below the bottom hole assembly 8 and below the drill bit 3 10.

It should be clearly understood that when the lower part of the tool assembly 160 is disposed below the bottom of the bottom hole assembly 8, the upper part of the tool assembly 160 can remain in the tubing string 12, for example, hung in or even above the bottom hole assembly 8. For purposes of defining this aspect of the present invention it is sufficient that the lower part of the tool assembly 160 reaches the second position 330 in the wellbore 1. It should be noted that various types of sensors may be included in the tool assembly 160 that can be used to measure one or more parameters in the wellbore 1 as the tool assembly 160 is lowered from the surface to the first position 328, with measurement data stored in an internal memory or storage device in the tool assembly 160 or transmitted to the surface, such as by mud pressure modulation telemetry or by electrical and/or optical cable. Examples of sensors are described above with reference to FIG. 25. If the tool assembly 160 is positioned or inserted in the coiled tubing string (12 in FIG. 1) at the first position 328 when the bottom hole assembly 8 is at or near the surface, then the sensors (not shown separately in FIG. 11) can also make measurements above the drill bit 310 in logging while drilling ("LWD") fashion as the wellbore 1 is drilled, in addition to measuring as described below when the tool assembly 160 is in the second position 330 as the tubing string 12 and drill bit 310 are withdrawn from the wellbore 1.

In this latter embodiment, with the tool assembly 160 at or near the first position 328, the portion of the tubing string 12, or segment (159 in FIG. 10A), adjacent to the tool assembly 160 can be composed of composite or other electrically non-conductive material to facilitate making measurements with sensors adversely affected by steel or other electrically conductive material. It is also possible that antenna coils (not shown) can be located in grooves cut into the outside of the segment (159 in FIG. 10A) of the tubing string 12 containing the tool assembly 160, and such antenna coils (not shown) used to make induction resistivity measurements of the formations outside the wellbore 1. Power to the antenna coils and signal received in the antenna coils can be communicated across the tubing wall using electrical feed-through bulkheads of types well known in the art. Such electrically non-conductive material, whether forming an entire segment of the tubing string 12 or whether in the form of "windows" in the tubing string 12, may also provide a path for electromagnetic energy if such is used for telemetry of data from the tool assembly 160 to the Earth's surface, and/or telemetry from the Earth's surface to the tool assembly 160.

In the description which follows, the terms upper and above are used to refer to a position or orientation relatively closer to the surface end of the tubing string 12, and the terms lower and below for a position relatively closer to the end of the wellbore during operation. The term longitudinal will be used to refer to a direction or orientation substantially along the axis of the tubing string 12.

The drill bit 310 can be provided with a releasably connected insert 335, which will be described in more detail with reference to FIG. 14. The insert 335 forms a selectively removable closure element for the passageway 320, when it is in its closing position, i.e. connected to the drill bit 310 as shown in the FIG. 11.

FIG. 11 further shows a transfer tool 338 which is arranged at the upper end of the tool assembly 160, and which serves to deploy the tool assembly 160 from its insertion point at the juncture of the connectors (28, 30 in FIG. 2) to the bottom hole assembly 8, for example, by pumping. For example, a transfer tool such as disclosed in published British Patent Application No. GB 2357787A can be used for such purpose.

Figure 12:
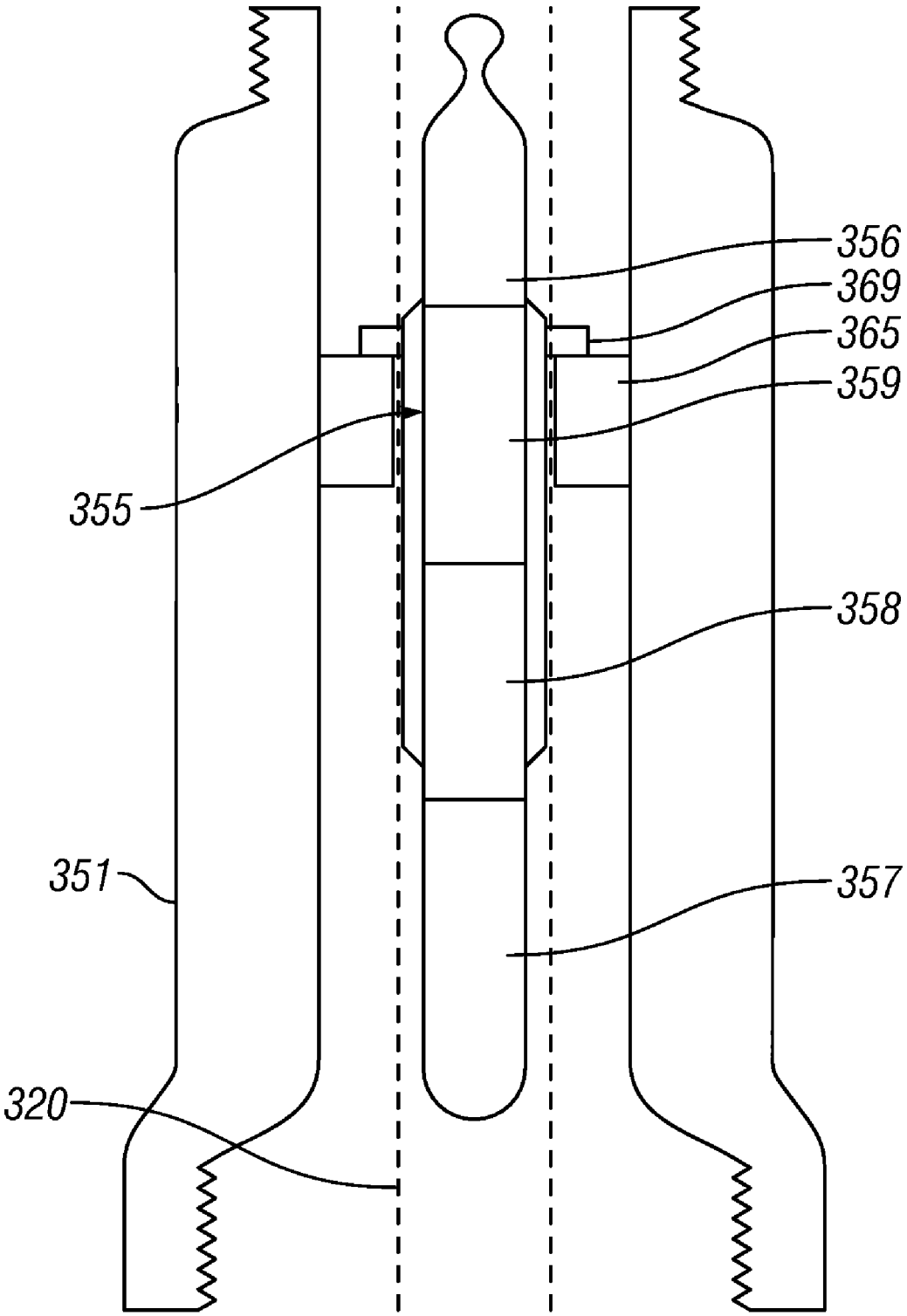
FIG. 12 shows a schematic drawing of the MWD/LWD survey system of FIG. 11.

Referring to FIG. 12, the surveying system 315 of FIG. 11 is shown in more detail. The surveying system of this embodiment can be a measurement/logging while drilling ("MWD/LWD") system comprising a tubular sub or collar 351 and an elongated probe 355. The upper end of the tubular sub 351 is connectable to the upper part of the tubing string 12 extending to the surface, and the lower end is connectable to the steering system 312. The probe 355 contains surveying instrumentation, a gamma ray instrument 356, an orientation tool 357 including e.g. an magnetometer and accelerometer for determining dip and azimuth of the wellbore, various logging sensors (such as electromagnetic, acoustic, or nuclear sensors), a battery pack 358, and a mud pulser 359 for data communication with the Earth's surface. The collar 351 can also contain surveying instrumentation. An annular shoulder 365 is arranged on the inner circumference of the tubular sub 351, on which the probe can be hung off. The outer surface of the probe is provided with notches on which keys 369 are arranged that co-operate with the annular shoulder 365. The notches allow for fluid to flow through the MWD/LWD system, and also induce the mud flow to go through the pulser section 359. The upper end of the probe 355 can include a connection means such as a fishing neck or a latch connector, which co-operates with a tool such as a wireline tool or a pumping tool that can be lowered from the Earth's surface and connected to the connection means. The probe 355 can thus be pulled or pumped upwardly so as to remove the probe 355 from the collar 351. The MWD/LWD system has dimensions such that the interior of the collar 351 after removal of the probe 355 represents a passageway 320 of suitable size for passage of at least the lower part of the tool assembly 160.

In other embodiments, a collar-based MWD/LWD system can be used, wherein all components are arranged around a central longitudinal passageway of required cross-section, and do not include the probe 355. In particular, a mud pulser can be provided that comprises a ring-shaped rubber member around the passageway, which can be inflated such that the rubber member extends into the passageway thereby creating a mud pulse. Other types of pulsers include valves that when open divert some of the fluid flow inside the tubing string into the annular space between the wellbore and the tubing string, and thus do not obstruct the central passageway. Still other MWD/LWD systems include no pulser. Such systems may include electromagnetic or acoustic telemetry to communicate data to the Earth's surface, or may merely record data in a suitable storage device in the MWD/LWD system itself, for recovery when the MWD/LWD system is removed to the Earth's surface.

Figure 13:
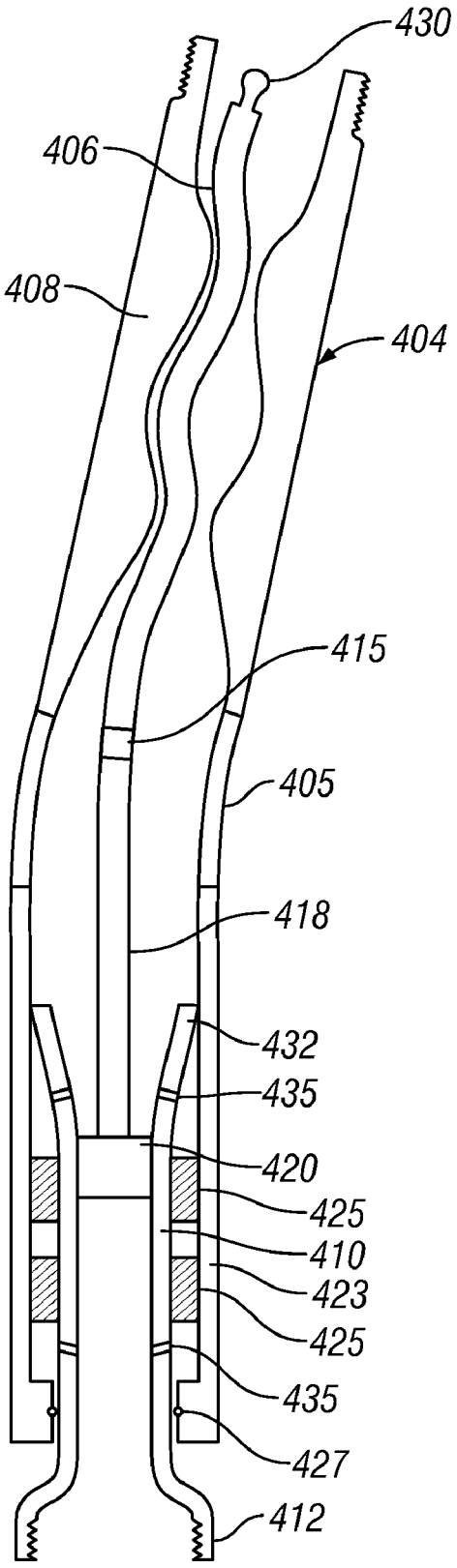
FIG. 13 shows a schematic drawing of the drill steering system of FIG. 11.

Referring to FIG. 13, an embodiment of the drill steering system 312 of FIG. 11, in the form of a mud motor 404 in combination with a bent housing 405 will now be explained. The bent housing 405 is shown with an exaggerated bend angle between the upper and lower ends for clarity of the illustration. Ordinarily, the bend angle is on the order of less than three degrees. The bent housing 405 has an interior comparable to ordinary positive displacement or turbine-type drilling motors. The upper end of the mud motor 404 can be directly or indirectly connected to the lower end of the surveying system 315.

A mud motor converts hydraulic energy from fluid (drilling mud) pumped from the Earth's surface to rotational energy to drive the drill bit (310 in FIG. 11). Such energy conversion enables bit rotation without the need for tubing string rotation, and thus is suitable for drilling using coiled tubing strings. The mud motor 404 schematically shown in FIG. 13 is a so-called positive displacement motor ("PDM"), which operates on the Moineau principle. The Moineau principle provides that a helically-shaped rotor, shown at 406, with one or more lobes will rotate when it is placed inside a helically shaped stator 408 having one more lobe than the rotor when fluid is moved through annulus between stator and rotor.

Rotation of the rotor 406 is transferred to a tubular bit shaft 410, to the lower end 412 of which the drill bit (310 in FIG. 11) can be connected. To transfer the rotation to the bit shaft 410, the lower end of the rotor 406 is connected via connection means 415 to one end of a transfer shaft 418. The transfer shaft 418 extends through the bent housing 405 and is on its other end connected to the bit shaft via connection means 420. The transfer shaft 418 can be a flexible shaft made from a material such as titanium that is able to withstand the bending and torsional stresses. Alternatively, the connection means 415 and 420 can be arranged as universal joints, constant velocity joints or other flexible coupling. The bit shaft 410 is suspended in a bit shaft collar 423, which is connected to or integrated with the stator 408, through bearings 425. A seal 427 is provided between bit shaft 410 and bit shaft collar 423.

The mud motor steering system of this embodiment differs from known systems in that the connection means 420 is arranged to release the connection between the transfer shaft 418 and the bit shaft 410 when upward force is applied to the rotor 406. For example, the connection means can be formed as co-operating splines on the lower end of the transfer tool and on the upper part of the bit shaft. A suitable latch mechanism that can be operated by longitudinal pulling/pushing is another option. In order to be able to apply upward force on the rotor 406, the upper end of the rotor is arranged as a connection means 430 such as a fishing neck or a latch connector, which co-operates with a tool that can be lowered from surface, connected to the connection means, and pulled or pumped upwardly so as to release the connection at connection means 420.

The upper end 432 of the bit shaft 410 is funnel-shaped so as to guide the lower end of the transfer tool 418 to the connection means 420 when the rotor 406 is lowered into the stator 408 again. Fluid passages 435 for drilling fluid can be provided through the wall of the bit shaft 410, to allow circulation of drilling fluid during drilling operation, when the rotor 406 is connected to the bit shaft 410 through connection means 420.

Suitably, there is also arranged a means (not shown) that locks the bit shaft 410 in the bit shaft collar 423 when the rotor 406 has been disconnected from the bit shaft 410. It shall be clear that the minimum inner diameter of the stator 408 and the bit shaft 410 are dimensioned such that a sufficiently large longitudinal passageway for at least the lower part of the tool assembly 160 is provided, forming part of the passageway 320 of FIG. 11.

An alternative drilling steering system is generally known as rotary steerable system. A rotary steerable system generally consists of an outer tubular mandrel having the outer diameter of the tubing string. Through the interior of the mandrel runs a piece of drill pipe of smaller diameter. The drill string or bottom hole assembly above the rotary steering system is connected to the upper end of this inner drill pipe, and the drill bit is connected to the lower end of the drill pipe. The mandrel comprises means to exert lateral force on the inner drill pipe so as to deflect the drill direction as desired. In order to be used with the present invention, the inner drill pipe of the rotary steering system must allow passage of an auxiliary tool. See, for example, U.S. Pat. Nos. 6,892,830; 6,837,315; 6,595,303; 6,158,529; and 6,116,354 for various implementations of rotary steerable directional drilling instruments.

Figure 14:
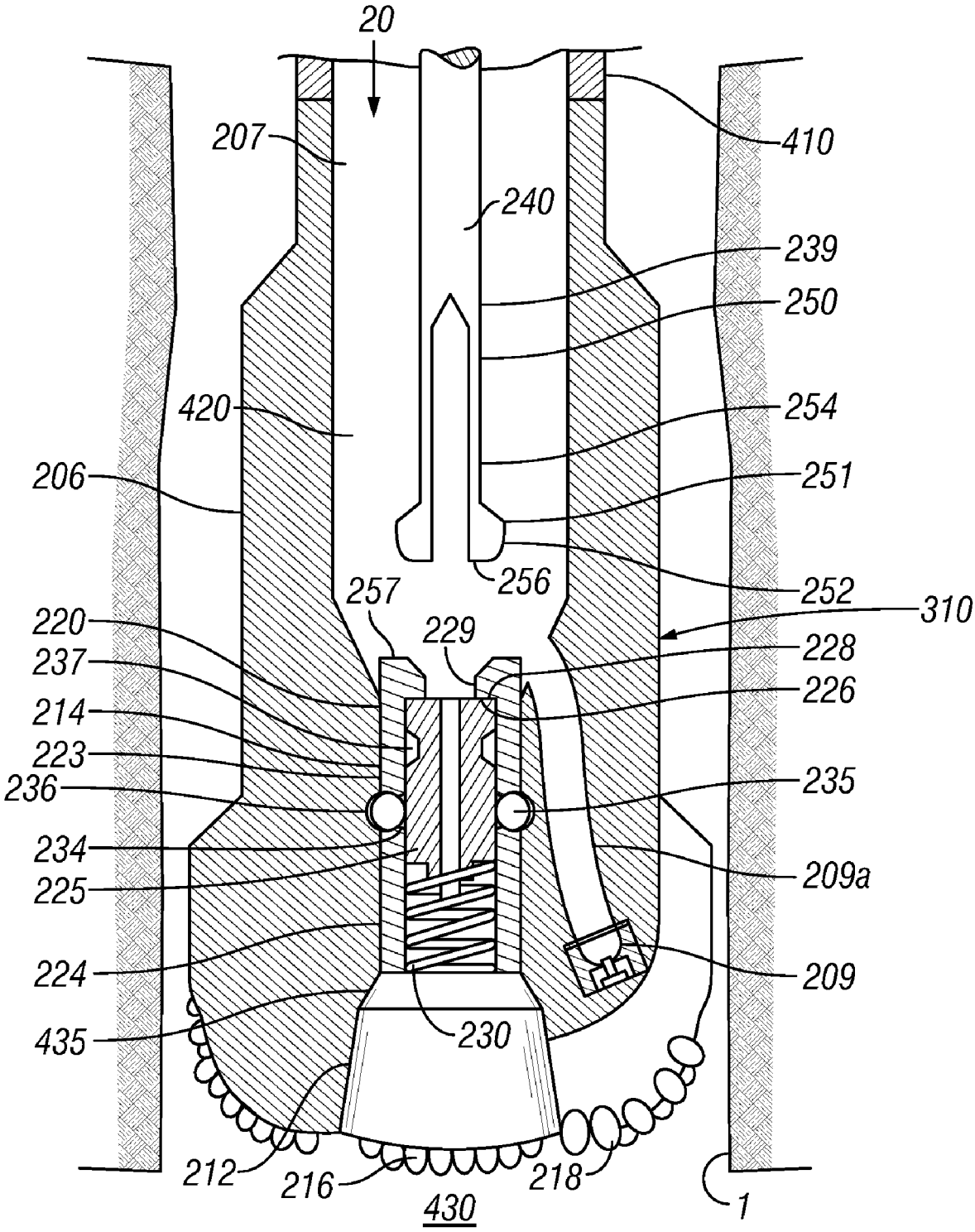
FIG. 14 shows a schematic drawing of the drill bit of FIG. 11.

Referring to FIG. 14, a schematically a longitudinal cross-section of an embodiment of the rotary drill bit 310 of FIG. 11 is shown. The drill bit 310 is shown in the wellbore 1, and is attached in this embodiment to the lower end of the bit shaft 410 of FIG. 13. The bit body 206 of the drill bit 410 has a central longitudinal passage 20 for an auxiliary tool from the interior 207 of the tubing string 12 to the wellbore 1 exterior of the drill bit 310, as will be explained in more detail below. Bit nozzles are arranged in the bit body 206. Only one nozzle with insert 209 is shown for the sake of clarity. The nozzle 209 is connected to the passageway 20 via the nozzle channel 209*a*.

The drill bit 310 is further provided with a removable closure element 435, which is shown in FIG. 14 in its closing position with respect to the passageway 420. The closure element 435 of this example includes a central insert section 212 and a latching section 214. The insert section 212 is provided with cutting elements 216 at its front end, wherein the cutting elements are arranged so as to form, in the closing position, a joint bit face together with the cutters 218 at the front end of the bit body 206. The insert section can also be provided with nozzles (not shown). Further, the insert section and the cooperating surface of the bit body 206 are shaped suitably so as to allow transmission of drilling torque from the bit shaft (410 in FIG. 13) and bit body 206 to the insert section 212.

The latching section 214, which is fixedly attached to the rear end of the insert section 212, has substantially cylindrical shape and extends into a central longitudinal bore 220 in the bit body 206 with narrow clearance. The bore 220 forms part of the passage 20, it also provides fluid communication to nozzles in the insert section 212.

The closure element 435 is removably attached to the bit body 206 by the latching section 214. The latching section 214 of the closure element 435 comprises a substantially cylindrical outer sleeve 223 which extends with narrow clearance along the bore 220. A sealing ring 224 is arranged in a groove around the circumference of the outer sleeve 223, to prevent fluid communication along the outer surface of the latching section 214. Connected to the lower end of the sleeve 223 is the insert section 212. The latching section 214 further comprises an inner sleeve 225, which slidingly fits into the outer sleeve 223. The inner sleeve 225 is biased with its upper end 226 against an inward shoulder 228 formed by an inward rim 229 near the upper end of the sleeve 223. The biasing force is exerted by a partly compressed helical spring 230, which pushes the inner sleeve 225 away from the insert section 212. At its lower end the inner sleeve 225 is provided with an annular recess 232 which is arranged to embrace the upper part of spring 230.

The outer sleeve 223 is provided with recesses 234 wherein locking balls 235 are arranged. A locking ball 235 has a larger diameter than the thickness of the wall of the sleeve 223, and each recess 234 is arranged to hold the respective ball 235 loosely so that it can move a limited distance radially in and out of the sleeve 223. Two locking balls 235 are shown in the drawing, however, more locking balls can be used in other implementations.

In the closed position as shown in FIG. 14 the locking balls 235 are pushed radially outwardly by the inner sleeve 225, and register with the annular recess 236 arranged in the bit body 206 around the bore 220. In this way the closure element 435 is locked to the drilling bit 410. The inner sleeve 225 is further provided with an annular recess 237, which is, in the closing position, longitudinally displaced with respect to the recess 236 in the direction of the bit shaft 410.

The inward rim 229 is arranged to cooperate with a connection means 239 at the lower end of an opening tool 240. The connection means 239 is provided with a number of legs 250 extending longitudinally downwardly from the circumference of the opening tool 240. For the sake of clarity only two legs 250 are shown, but it will be clear that more legs can be arranged. Each leg 250 at its lower end is provided with a dog 251, such that the outer diameter defined by the dogs 251 at position 252 exceeds the outer diameter defined by the legs 250 at position 254, and also exceeds the inner diameter of the rim 229. Further, the inner diameter of the rim 229 is preferably larger or about equal to the outer diameter defined by the legs 250 at position 254, and the inner diameter of the outer sleeve 223 is smaller or approximately equal to the outer diameter defined by the dogs 251 at position 252. Further, the legs 250 are arranged so that they are inwardly elastically deformable. The outer, lower edges 256 of the dogs 251 and the upper inner circumference 257 of the rim 229 are beveled.

The outer diameter of the opening tool 240 is significantly smaller than the diameter of the bore 220.

Operation of the embodiment of FIGS. 11-14 will now be described. The tubing string 12 can be used for progressing the wellbore 1 into the formation 2, when the MWD/LWD probe 355 hangs in the collar 351 as shown in FIG. 12, when the rotor 406 is arranged in the stator 408 of the mud motor 404 as shown in FIG. 13, and when the insert 435 is latched to the bit body 206 as shown in FIG. 14. The tool assembly 160 would normally be stored at surface. The tubing string 12 can thus be used to drill the wellbore 1 into a desired subsurface position. The probe 355, the rotor 406 and the insert 435 together form a closure element for the passageway 20.

In the course of the drilling operation a situation can be encountered, which requires the operation of the tool assembly 160 in the wellbore 1 ahead of the drill bit 310. This will be referred to as a tool operating condition. Examples are the occurrence of mud losses which require the injection of fluids such as lost circulation material or cement, performing a cleaning operation in the open wellbore, the desire to perform a special logging, measurement, fluid sampling or coring operation, the desire to drill a pilot hole.

Drilling is stopped then the tubing string 12 is pulled up a certain distance to create sufficient space for at least part of the tool assembly (160 in FIG. 10) at position 430, and the passageway is opened. To open the passageway in the present embodiment the MWD/LWD probe 355 and the rotor 406 can be retrieved to surface, such as by using a fishing tool with a connector means at its lower end that can be pumped down or upwardly through the drill string and can also be pulled up again by wireline. Retrieving of the MWD/LWD probe and the rotor can be done in consecutive steps. The lower end of the probe can also be arranged so that it can be connected to the connection means 430 at the upper end of the rotor 406, so both can be retrieved at the same time. It will be appreciated by those skilled in the art that the foregoing operation may be performed by suitable location of connectors (28, 30 in FIG. 1) in the tubing string 12, such as explained above with reference to FIG. 10. When a set of connectors (28, 20 in FIG. 10) is positioned suitably above the top of the wellbore, the connectors are disconnected, and a slickline (not shown) or similar device with an appropriate retrieval latch may be lowered into the interior of the tubing string 12 to retrieve the probe 355 and rotor 406. After the probe 355 and rotor 406 are retrieved from the bottom hole assembly 8, the tool assembly 160 may be inserted into the tubing string 12. In embodiments of a survey system that do not include the probe (355 in FIG. 11), it is not necessary to use slickline or the like for such purpose.

The opening tool 240 can then be deployed, through the interior of the tubing string 12, so as to outwardly remove the closure element 435 from bit body 206. The opening tool 240 is affixed to the lower end of the tool assembly 160. The tool assembly 160 can be deployed from surface by pumping through the interior of the tubing string 12, with the transfer tool 338 connected to the upper end of the tool assembly 160 (the tool can be logging, as described above, as it is lowered to contact the BHA). The tool assembly 160 passes though the tubing string 12 and the passageway 320 of the bottom hole assembly 8, i.e. consecutively through the MWD collar 351 and the stator 408 of the mud motor, until it reaches the upper end of the drill bit 310, so that the connection means 239 engages the upper end of the latching section 214 of the closure element 435. The dogs 251 slide into the upper rim 229 of the outer sleeve 223. The legs 250 are deformed inwardly so that the dogs 251 can slide fully into the upper rim 229 until they engage the upper end 226 of the inner sleeve 225. By further pushing down, the inner sleeve 225 will be forced to slide down inside the outer sleeve 223, further compressing the spring 230. When the space between the upper end 226 of the inner sleeve 225 and the shoulder 228 has become large enough to accommodate the length of the dogs 251, the legs 250 snap outwardly, thereby latching the opening tool 240 to the closure element 435.

At approximately the same relative position between inner and outer sleeves, where the legs snap outwardly, the recesses 237 register with the balls 235, thereby unlatching the closure element 435 from the bit body 206. At further pushing down of the opening tool 240 the closure element 435 is integrally pushed out of the bore 220. When the closure element 435 has been fully pushed out of the bore 220, the passageway 320 is opened.

By moving the opening tool 240 further, the lower part of the tool assembly 160 at the upper end of the opening tool 240 enters the open wellbore 1 outside of the drill bit 310, and it can be operated there. In this embodiment the tool assembly 160 is long enough so that it extends through the entire bottom hole assembly 8 and remains connected to the transfer tool 338 above the bottom hole assembly 8. This allows straightforward retrieval of the tool assembly 160 to the surface, by slickline, wireline or reverse pumping. The wellbore 1 below the drill bit 310 may be surveyed by moving the entire tubing string 12 along the wellbore by reeling the reel (14 in FIG. 1).

Figure 15:
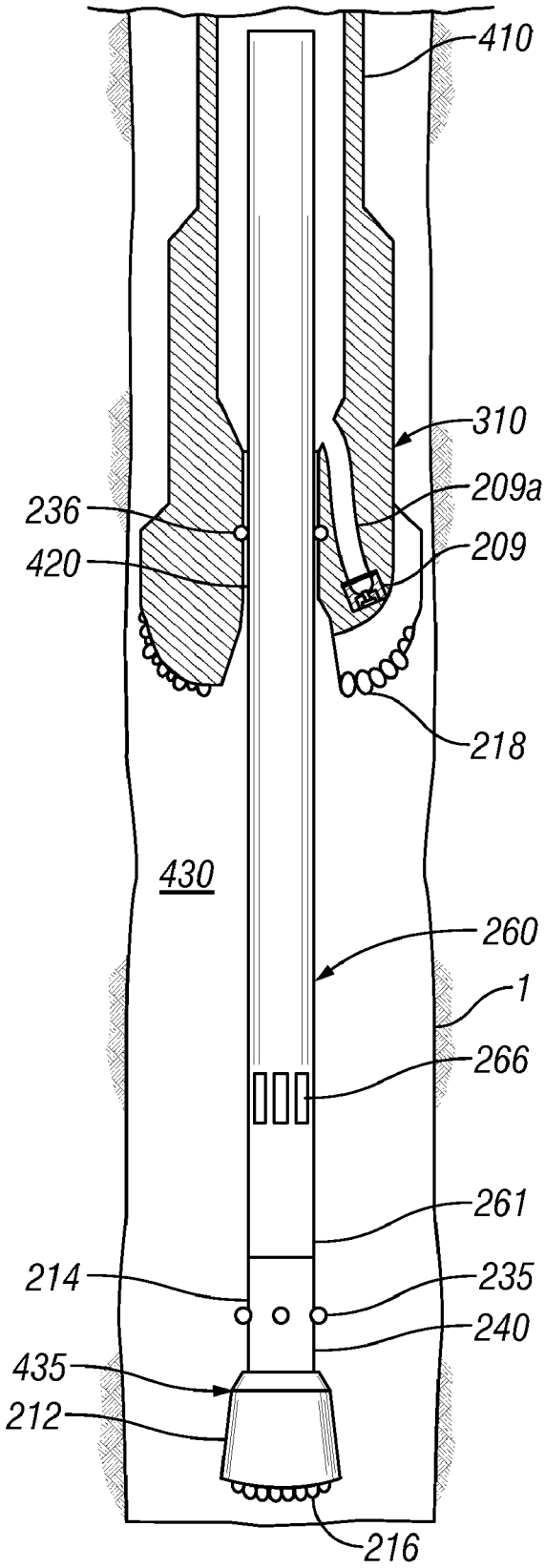
FIG. 15 shows a schematic drawing of logging tool that has been passed through the bottom hole assembly to extend into the wellbore ahead of the drill string.

FIG. 15 shows the lower end of the drill bit 310 in the situation that a logging tool 260, of which the lower part 261 has been passed through the passageway. The closure element 435 has been outwardly removed from the closing position by the opening tool 240 disposed at the lower end of the logging tool 260.

A number of sensors and/or electrodes of the logging tool are shown at 266. They can be battery-powered, or can be powered by a turbine or through electrical power transmitted along a wireline extending to surface. Data can be stored in the logging tool 260 or transmitted to surface. The logging tool 260 further comprises a landing member (not shown) having a landing surface, which cooperates with a landing seat of the bottom hole assembly 8.

In one example, the drill bit 310 can for example have an outer diameter of 21.6 cm (8.5 inch), with a passageway of 6.4 cm (2.5 inch). The lower part 261 of the logging tool, which is the part that has passed out of the drill string onto the open wellbore, is in this case substantially cylindrical and has a relatively uniform outer diameter of 5 cm (2 inch). In one embodiment, the portion of the drill bit lowered beneath the tool assembly 160 can be used to continue to drill a smaller diameter bore hole for some distance below the bottom of the existing wellbore, with the sensors 266 in tool 260 continuing to measure and store and/or transmit measurement data as the smaller diameter borehole is being drilled. Drilling power may be provided by an electrical connection (not described) to the surface and a downhole electric motor, or by an additional mud motor (not shown). When the smaller borehole is drilled to the depth desired, the same sensors in the tool assembly 160 can measure, store and/or transmit data as the tubing string 12 is inserted into and/or withdrawn from the wellbore.

After the tool assembly 160 has been operated in the wellbore at 430, it can be retrieved into the tubing string 12 by pulling up the transfer tool 338. The closure insert 435 will then reconnect to the bit body 206. The opening tool 240 will disconnect from the insert 435, and the tool assembly 160 can be fully retrieved to the surface. Rotor 406 and MWD/LWD probe 355 can be lowered into the mud motor and MWD/LWD stator 408, respectively, so that the closure element is complete again, and drilling can be resumed. If a following tool operation condition occurs, the whole cycle can be repeated, wherein in particular a different tool assembly can be used. The flexibility gained in this way during a directional drilling operation is a particular advantage of the present embodiment.

An alternative design to the removable center portion of the drill bit as explained above with reference to FIGS. 11 through 15 is described in U.S. Patent Application Publication No. 2005/0029017, by Berkheimer et al., wherein the entire drill bit and/or entire bottom hole assembly is released and lowered below the tool assembly.

Yet another alternative embodiment is disclosed in U.S. Patent Application Publication No. 2006/0118298 filed by Millar et al. incorporated herein by reference, which discloses a tubing string assembly comprising a tubular first tubing string part with a passageway, and a second tubing string part co-operating with the first tubing string part. The assembly includes a releasable tubing string interconnecting means for selectively interconnecting the first and second tubing string parts. An auxiliary tool is provided for manipulating the second tubing string part. The auxiliary tool can pass along the passageway in the first tubing string part to the second tubing string part. The assembly further includes a tool-connecting means for selectively connecting the auxiliary tool to the second tubing string part, and an operating means for operating the tubing string-interconnecting means.

Wardley, U.S. Pat. No. 6,443,247, discloses a casing drilling shoe adapted for attachment to a casing string. The shoe comprises an outer drilling section constructed of a relatively hard material and an inner section made from a readily drillable material. The shoe includes means for controllably displacing the outer drilling section to enable the shoe to be drilled through using a standard drill bit and subsequently penetrated by a reduced diameter casing string or liner. Optionally, the outer section may be made of steel and the inner section may be made of aluminum. In some embodiments of a system according to the invention, the drill bit (310 in FIG. 11) may be substituted by a drilling shoe as disclosed in the Wardley patent. Such a drilling shoe in the invention may be rotated by an annular drilling motor, as will be explained in more detail below with reference to FIG. 17. Such combination may be in substitution for all the components shown in FIGS. 11-15 between the lower end of the tubing string 12 and the drill bit 310. In using components such as shown in the Wardley patent with coiled tubing according to the invention, the wellbore is drilled to a selected depth. The tubing string may be withdrawn a selected distance out from the well. A tool assembly as explained above with reference to FIG. 10 may then be inserted into the tubing string 12. The tool assembly in such embodiments may have a device at the bottom end thereof that may open the outer section of the drilling shoe. The tool assembly may include a mill, bit or similar device on the bottom thereof that may be operated by an electric, hydraulic or drilling fluid-driven motor to rotate the mill or bit. Thus, the inner portion of the drilling shoe may be removed, and the tool assembly may be projected below the bottom of the tubing string into the wellbore below the bottom end of the tubing string.

Preferably, the outer section of the Wardley-type drilling shoe is provided with one or more blades, wherein the blades are moveable from a first or drilling position to a second or displaced position. Preferably, when the blades are in the first or drilling position they extend in a lateral or radial direction to such extent as to allow for drilling to be performed over the full face of the shoe. This enables the casing shoe to progress beyond the furthest point previously attained in a particular well.

The means for displacing the outer drilling section may comprise of a means for imparting a downward thrust on the inner section sufficient to cause the inner section to move in a down-hole direction relative to the outer drilling section. The means may include an obstructing member for obstructing the flow of drilling mud so as to enable increased pressure to be obtained above the inner section, the pressure being adapted to impart the downward thrust. Typically, the direction of displacement of the outer section has a radial component.

Figure 16:
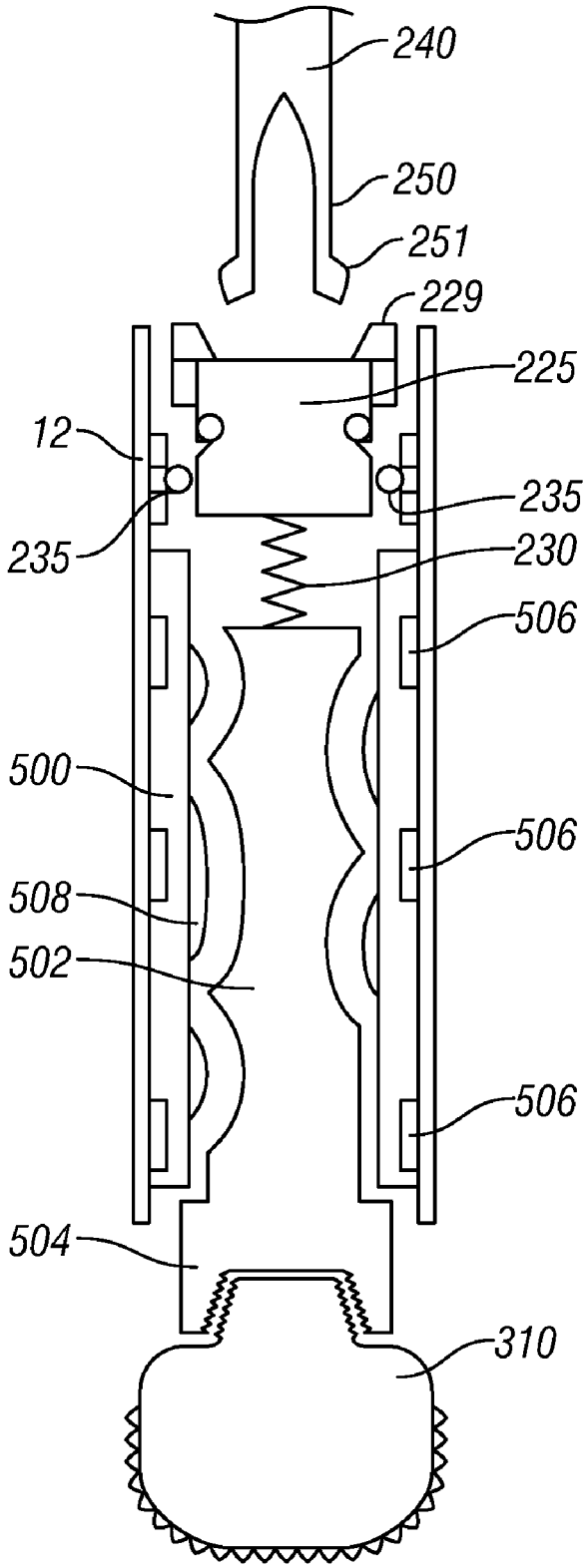
FIG. 16 shows a mud motor having a releasable rotor or rotor and stator combination to enable movement of wellbore logging instruments below the bottom of the coiled tubing into the open wellbore.

An alternative embodiment of a mud motor 500 in which all of the internal components of the motor may be moved out of the bottom of the coiled tubing string will now be explained with reference to FIG. 16. The motor includes a housing 500 that is slidably inserted into the bottom of the tubing string 12. The bottom of the tubing string 12 may be particularly formed for the purpose of mounting the motor, or the motor may be mounted in a drill collar or similar device coupled to the lower end of the tubing string 12. The interior of the tubing string or collar includes splines or Woodruff keys 506 that mate with corresponding slots in the exterior surface of the motor housing 500. The keys or splines 506 rotationally fix the motor housing 500 with respect to the tubing string 12, but enable the motor housing 500 to move axially within the tubing string 12 or collar. In the present embodiment, the motor housing 500 may be axially locked within the interior of the tubing string 12 or collar using a locking device substantially as explained with reference to FIG. 14, including, for example, an opening tool 240 coupled to the lower end of the tool assembly (160 in FIG. 10) having dogs 250 or the like at the lowermost end. The dogs 250 interact with collets 229 on the upper end of the locking device to engage the release tool to the upper end of the motor. Movement of the opening tool 240 to engage the locking device enables release shaft 225 to move upward under bias from a spring 230, such that locking balls 235 are move out of engagement with locking features in the wall of the tubing string or collar. Thus, continued movement of the tool assembly 160 downward will cause the motor housing 500 to be moved axially out of the bottom of the tubing string or collar. As the motor housing 500 is moved outward from the interior of the tubing string or collar, all the motor internal active components move therewith, including a rotor 502 having bit box 504 (and drill bit 310 coupled therein) coupled thereto, and the stator 508. When the motor housing is thus moved out of the bottom of the tubing string or collar, a relatively large diameter through bore is created, through which the tool assembly (160 in FIG. 10) may pass into the wellbore below the bottom of the tubing string. The embodiment shown in FIG. 16 may be operated substantially as explained above with reference to FIGS. 11-15, the difference in the present embodiment being that it is not necessary to use slickline or other conveyance to remove the rotor 502 and other components (such as the MWD/LWD probe) prior to moving the tool assembly (160 in FIG. 10) into the wellbore below the bottom of the tubing string or collar.

In other embodiments, the drill bit 310 may be substituted by a roller cone bit. One of the cones on the roller cone bit is substituted by a flapper or similar cover which can be opened to provide passage of the tool assembly 160 below the bit 310, as described in Estes, U.S. Pat. No. 5,244,050.

Figure 17:
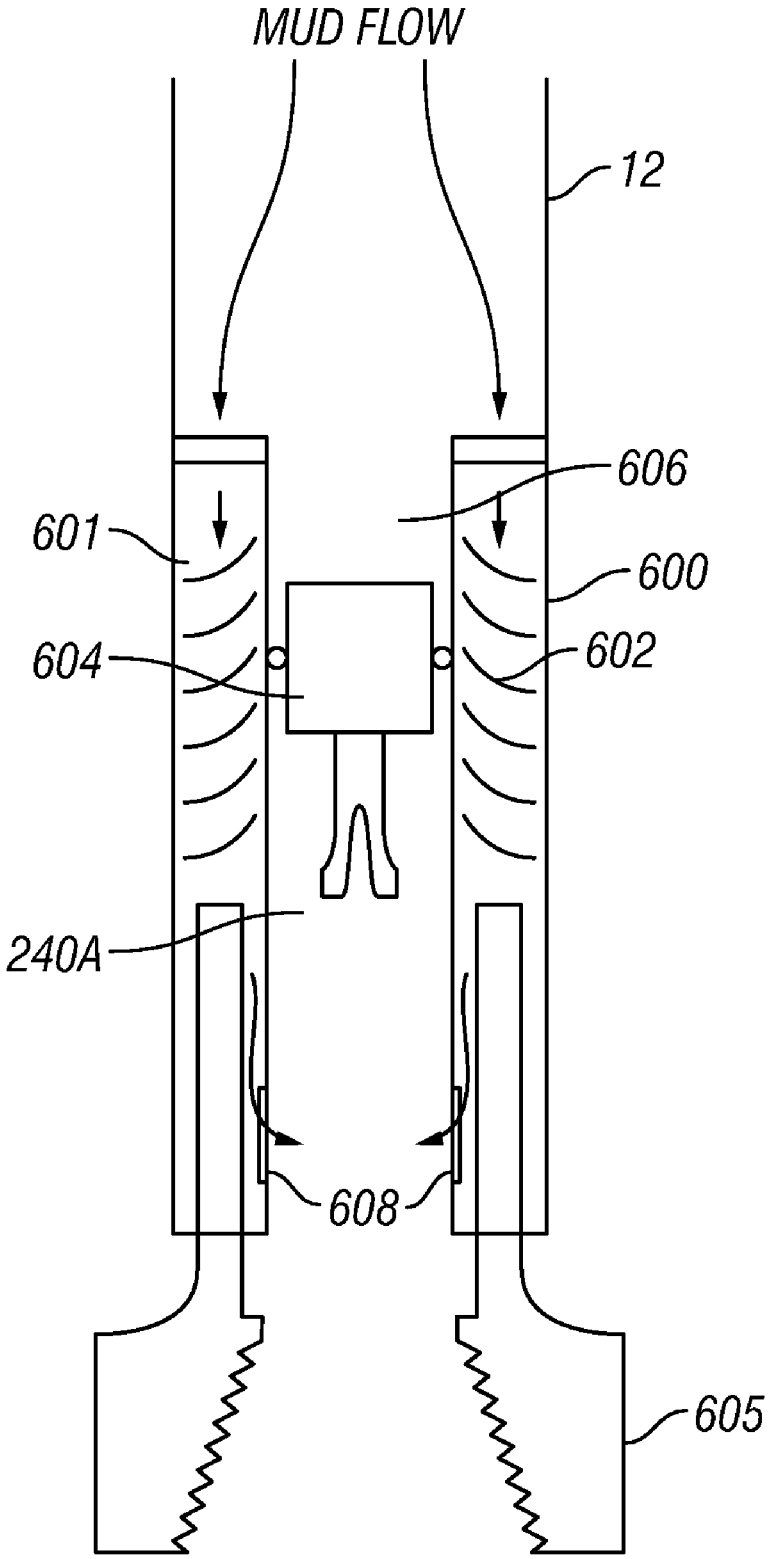
FIG. 17 shows one embodiment of an annular mud motor that may be used in accordance with the invention.

Another embodiment of a mud motor having a through passage for the tool assembly (160 in FIG. 10) is shown in FIG. 17. The embodiment shown in FIG. 17 can be referred to as an annular motor, because the rotating components of the motor are disposed in an annular space 601 between an interior bore 606 and an outer surface of the motor housing 600. The motor housing 600 is adapted to be coupled to the lower end of the tubing string 12. Rotating components in the present embodiment can include a turbine 602, or may include positive displacement ("PDM") components, including but not limited to a Moineau-type rotor and stator combination. Rotational output of the turbine 602 or PDM can be coupled to a bit box 605 of configurations wellbore known in the art. In the present embodiment, the mud or other fluid pumped down the interior of the tubing string 12 has flow indicated by the arrows in FIG. 17. The center bore 606 in the operating configuration shown in FIG. 17 includes a locking plug 604 that may be latched within the internal bore 606 using a latching mechanism similar to that shown in and explained with reference to FIG. 14. When the locking plug 604 is latched in place in the internal bore 606, fluid flow is diverted to the annular space to drive the turbine 602 (or PDM). Fluid can return to the interior bore 606 through ports 608 at the lower end of the power section of the motor.

When the user desires to move the tool assembly (160 in FIG. 10) outward through the bottom of the tubing string 12 into the open wellbore below, the tool assembly is moved downward until the opening tool (240 in FIG. 14) couples with and releases the locking plug 604. The locking plug 604 then moves downward with the tool assembly (160 in FIG. 10). The locking plug 604 in the present embodiment includes releasing features 240A that are substantially the same as the opening tool (240 in FIG. 14). Thus, the locking plug 604 may be moved to release a center section of the drill bit substantially as explained with reference to FIGS. 11 through 15. When such center section is released, the tool assembly (160 in FIG. 10) may be moved through the center opening in the drill bit and into the wellbore below the bottom of the tubing string 12. Making formation evaluation or similar measurements using the various sensors on the tool assembly may be performed substantially as explained above with reference to FIGS. 11 through 15. Relatching both the center bit section and the locking plug 604 may be performed substantially as explained with reference to FIGS. 14 and 15.

Figure 18:
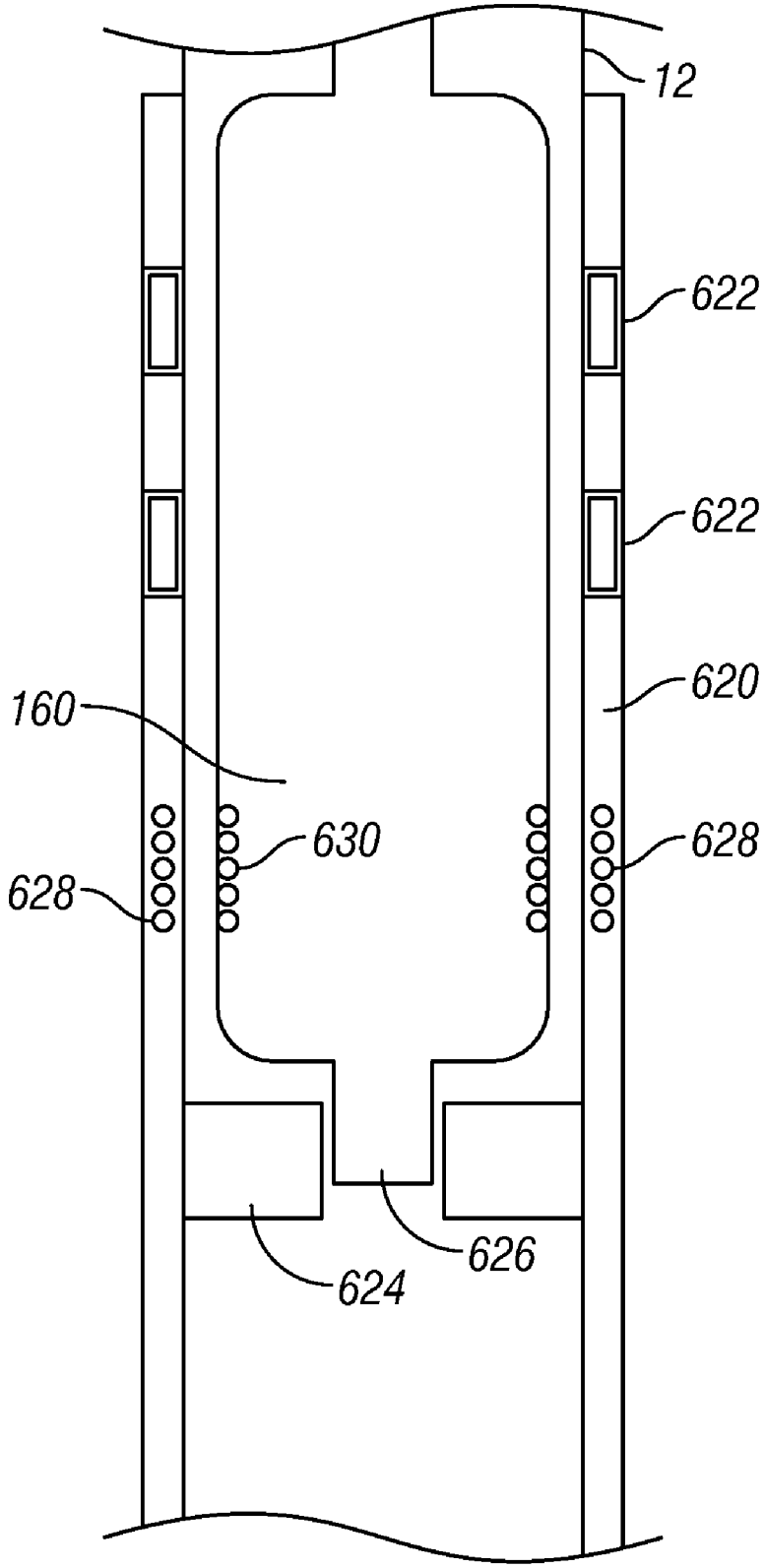
FIG. 18 shows an alternative embodiment in which wellbore logging sensors remain within the tubing string during operation.

Another embodiment is shown in FIG. 18 in which wellbore logging sensors or similar apparatus remains inside the tubing string 12 during operation. A sub or collar 620 is coupled to the lower end of the tubing string 12. The collar 12 may be made from composite, electrically non-conductive material such as glass fiber reinforced plastic, or may be made from high strength metal such as titanium. In the case of a metal collar, it may be useful for certain types of wellbore logging sensors to include radiation transparent windows 622 located to be aligned with the sensor (not shown) on the tool assembly 160. In the present embodiment, the tool assembly 160 may include an alignment key 626 at its lowermost end, rather than the opening tool (240 in FIG. 14) used in other embodiments. When the tool assembly 160 is inserted into and is moved through the tubing string 12, the key 626 may seat in a keyway 624 in the collar 620. The tool assembly 160 may also be inserted into the collar 620 prior to inserting the tubing string 12 into the wellbore. Wellbore logging operations may take place with the tool assembly 160 seated as shown in FIG. 18 while the tubing string 12 is moved into and/or out of the wellbore, while drilling or otherwise. Information measured by the various sensors (not shown separately) on the tool assembly 160 may be recorded in a device in the tool assembly 160, or may be communicated by one or more types of telemetry, including fluid pressure modulation, electromagnetic radiation, and/or communication along an electrical cable (not shown). In some implementations, an antenna in the form of a longitudinally wound coil 628 may be embedded in the wall or in a recess in the wall of the collar 620. The antenna 628 may be used to communicate signals to and from the tool assembly 160 through a corresponding antenna 630, or to communicate signals to and from a different location.

Figure 19:
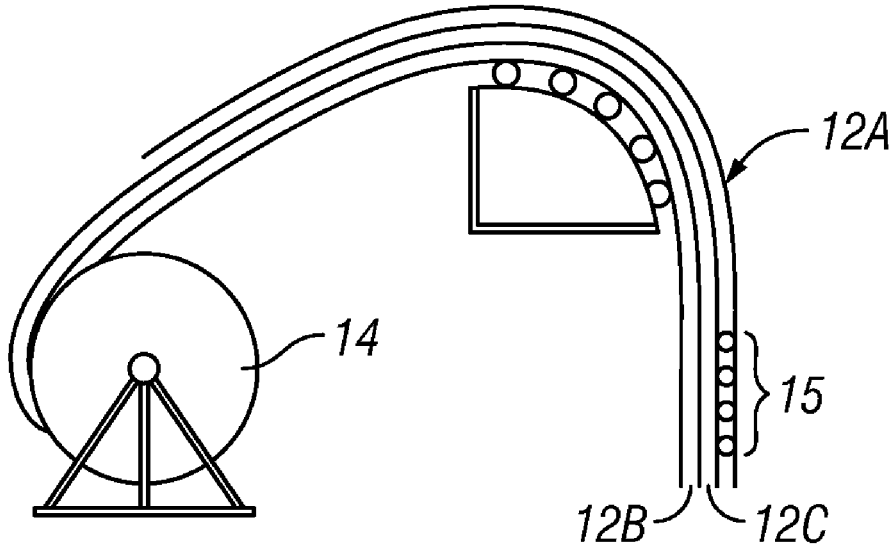
FIGS. 19 and 20 show an embodiment of a coaxial, dual coiled tubing.

Another embodiment of a coiled tubing string that may be advantageously used with the annular motor explained with reference to FIG. 17 will now be explained with reference to FIGS. 19 and 20. A coaxial, dual coiled tubing 12A is shown being deployed into the wellbore from a reel 14 in FIG. 19. The coaxial, dual coiled tubing 12A includes a substantially open, central passage or conduit 12C. Coaxially disposed about the central conduit 12C is an annulus 12B. The annulus 12B preferably can provide an hydraulic path from the Earth's surface to the bottom end of the dual coiled tubing 12A, just as can the central conduit 12C. As will be appreciated by those skilled in the art, the dual coiled tubing 12A may include one or more connectors as explained above with reference to FIGS. 1-10 for insertion of a tool assembly into the central conduit 12C. Such tool assembly may be used according to any one or more of the previously described embodiments.

In another dual tubing embodiment, a turbine with a central passage to enable tools to pass through can be used in the lower portion of the tubing string 12. Such a turbine is disclosed, for example, in U.S. Pat. No. 6,527,513 to Van Drentham-Susman et al.

Figure 20:
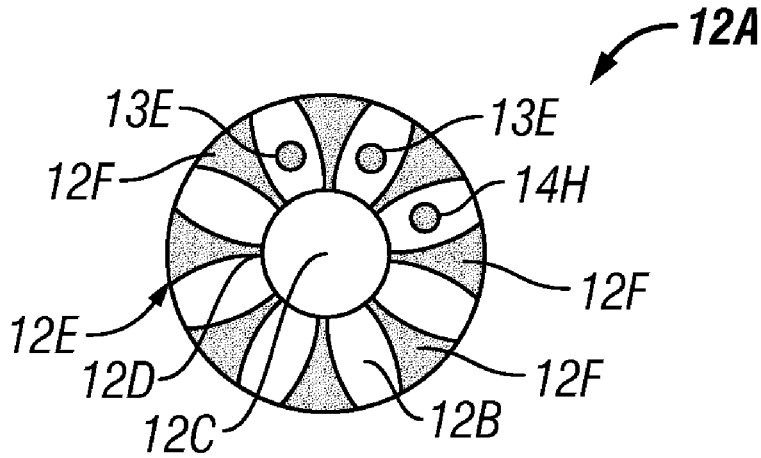

A possible structure for a coaxial, dual coiled tubing 12A is shown in cross section in FIG. 20. The tubing 12A includes an outer tube 12E and an inner tube 12D. The inner tube 12D defines therein in its interior the central conduit 12C. The inner tube 12D may be joined to the outer tube 12D by circumferentially spaced apart supporting ribs 12F. The supporting ribs 12F transfer lateral and bending stresses between the inner tube 12D and outer tube 12E to maintain the shape and profile of the dual coiled tubing 12A. Interior passages disposed between the ribs 12F define the passages of the annulus 12B. One or more of the passages may have therein disposed electrical lines or cables 13E, or hydraulic lines 14H. Such lines and cables may be used in some embodiments to supply power to operate the tool assembly (160 in FIG. 10) in the wellbore, and/or to communicate signals from the tool assembly to the Earth's surface. The hydraulic lines could also be used to activate mechanical devices in the bottom hole assembly, including the latching and unlatching assemblies associated with moving and positioning the tool assembly 160 below the drill bit 310, and if desired, retrieval of the tool assembly 160 and displaced drill bit 310 back into their ordinary drilling position. In some embodiments the tool assembly 160 can be stored in a side pocket while drilling the well and/or while extending the tubing string 12 into the wellbore. The hydraulic or electrical power could also be used in such circumstances to rotate or otherwise move the tool assembly 160 from the side-pocket position into the operating position below the bottom hole assembly as explained with reference to FIG. 15. It is contemplated that the dual coiled tubing shown in FIG. 19 may be advantageously used with the annular motor shown in FIG. 17, however the annulus 12B when used with electrical and/or hydraulic lines may also operate devices such as electric and/or hydraulic motors to operate the drill bit (310 in FIG. 14). For embodiments of a dual coiled tubing made from steel or similar metal, it is contemplated that the dual coiled tubing 12A may be made by continuous extrusion over an extruder die or similar manufacturing technique. It is also within the scope of this invention to place one or more sensors (15 in FIG. 19) in selected positions along the tubing 12A in the annulus 12B. Such sensors may measure fluid pressure, temperature, signals from the tool assembly (160 in FIG. 10) and any other parameters that would occur to those of ordinary skill in the art. Referring to FIG. 1, in which one of the wellbore tools disposed in the tubing string is a packer 18, it is possible using such packer to seal the wellbore against the exterior of the tubing string 12 so that selected fluid flow paths with respect to the tubing 12A can be isolated. In the example dual coiled tubing of FIG. 19, fluid can be pumped down the annulus 12B and returned through the central conduit 12C, or vice versa, while the annular space between the wellbore and the outer tube 12E remains sealed against fluid flow by the packer (18 in FIG. 1). Since the central conduit 12C is open from the surface to the bottom hole assembly, there being no rotor/stator assembly or other device to impede or block the passageway, the tool assembly 160 can be positioned and lowered in the central conduit 12C from the surface to the bottom hole assembly, and then further lowered into open borehole below the bottom hole assembly as described earlier with reference to FIG. 15. It may be possible, when the tool assembly 160 is lowered into such position, for an upper portion of tool assembly 160 to contain a transmitter (e.g., electromagnetic or acoustic) that can be aligned with a corresponding receiver disposed in the bottom hole assembly. Sensor signals from the various sensors generated in the tool assembly 160 can then be transferred from the tool assembly 160 to the receiver in the bottom hole assembly, and then further transmitted to the surface by any of mud pulse telemetry up the central conduit 12C or annulus 12B, acoustic telemetry up one of the coaxial coiled tubular strings, or along an electrical cable in the annulus 12B.

Other embodiments of a non-coaxial dual coiled tubing that may be used in some embodiments may be similar to a composite coiled tubing such as disclosed in U.S. Pat. No. 5,285,008 to Sas-Jaworsky et al., or U.S. Pat. No. 6,663,453 to Quigley, incorporated herein by reference.

Figure 21:
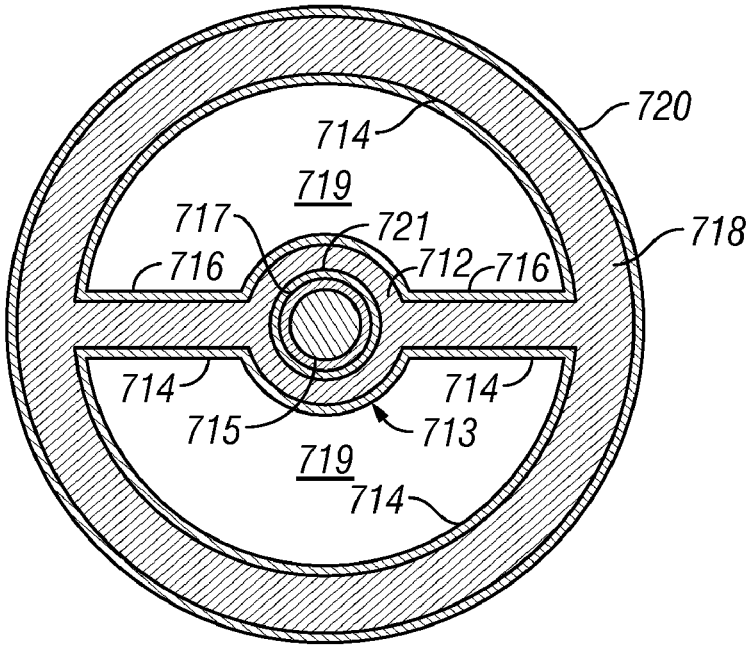
FIGS. 21 and 22 show embodiments of side by side dual coiled tubing.
Figure 22:
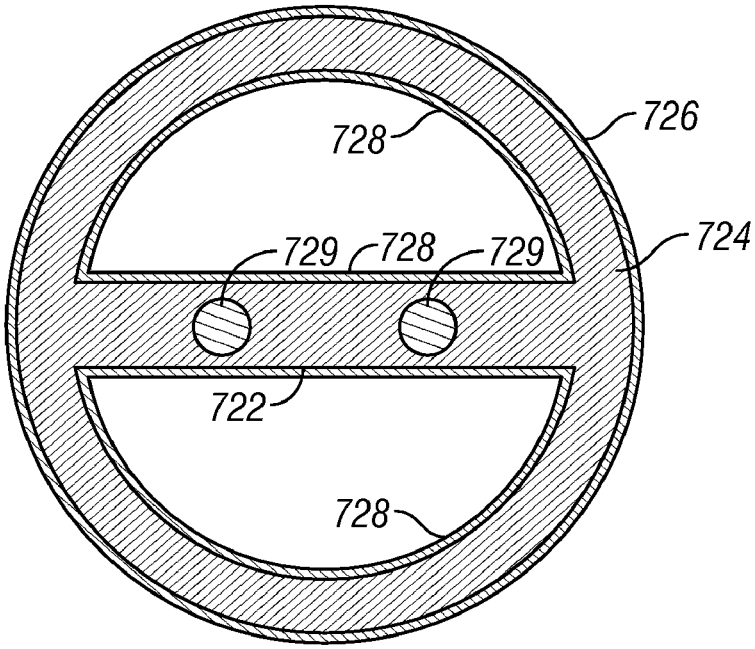

FIGS. 21 and 22 show embodiments of a dual coiled tubing as in the Sas-Jaworsky et al. patent. In FIG. 21 an outer composite cylindrical member 718 is joined to a centrally located core member 712 by web members 716 to form two opposing cells 719. The cells 719 are lined with an abrasive resistant, chemically resistant material 714 and the exterior of the composite tubular member is protected by an abrasion resistant cover 720. At the center of core member 712 is an optional electrical conductor 715 having an insulating sheath 717 surrounding the conductor 715. A braided or woven sheath 721 of electrically conductive material is shown formed about the insulating sheath 717. The conductor 715 and sheath 721 form an electrical pair of conductors for operating tools, instruments, or equipment downhole, which tools are operably connected to the composite tubular member.

One advantage of the composite tubular member shown in FIG. 21 is that the core 712 contains zero-degree oriented fibers which can assume large displacement away from the center of the cross-section of the composite tubular member during bending along with tube flattening to achieve a minimum energy state. Such deformation state has the beneficial result of lowering critical bending strains in the tube. The secondary reduction in strain will also occur in composite tubular members containing a larger number of cells, but is most pronounced for the two cell configuration.

A variation in design in the two cell configuration is shown in FIG. 22 in which the zero degree oriented fiber 722 is widened to provide a plate-like core which extends out to the outer cylindrical member 724. In effect, the central core member and the web members are combined to form a single web member of uniform cross-section extending through the axis of the composite tubular member. Two optional conductors 729 are shown spaced apart in the material 722 forming a plate-like core. If mud pulse telemetry or acoustic telemetry up the tubing string are used to send data from the tool assembly to the surface, it may be possible in some embodiments to place a special fluid either in the annulus of a concentric dual coiled tubing, or in one of the isolated dual tubes as shown in FIGS. 21 and 22 to facilitate mud pulse or acoustic up-the-pipe telemetry. It is also possible that the side-by-side coiled tubings as described in FIGS. 21 and 22 could be made from metallic material housed in a spoolable outer metallic or composite sheath.

Figure 23:
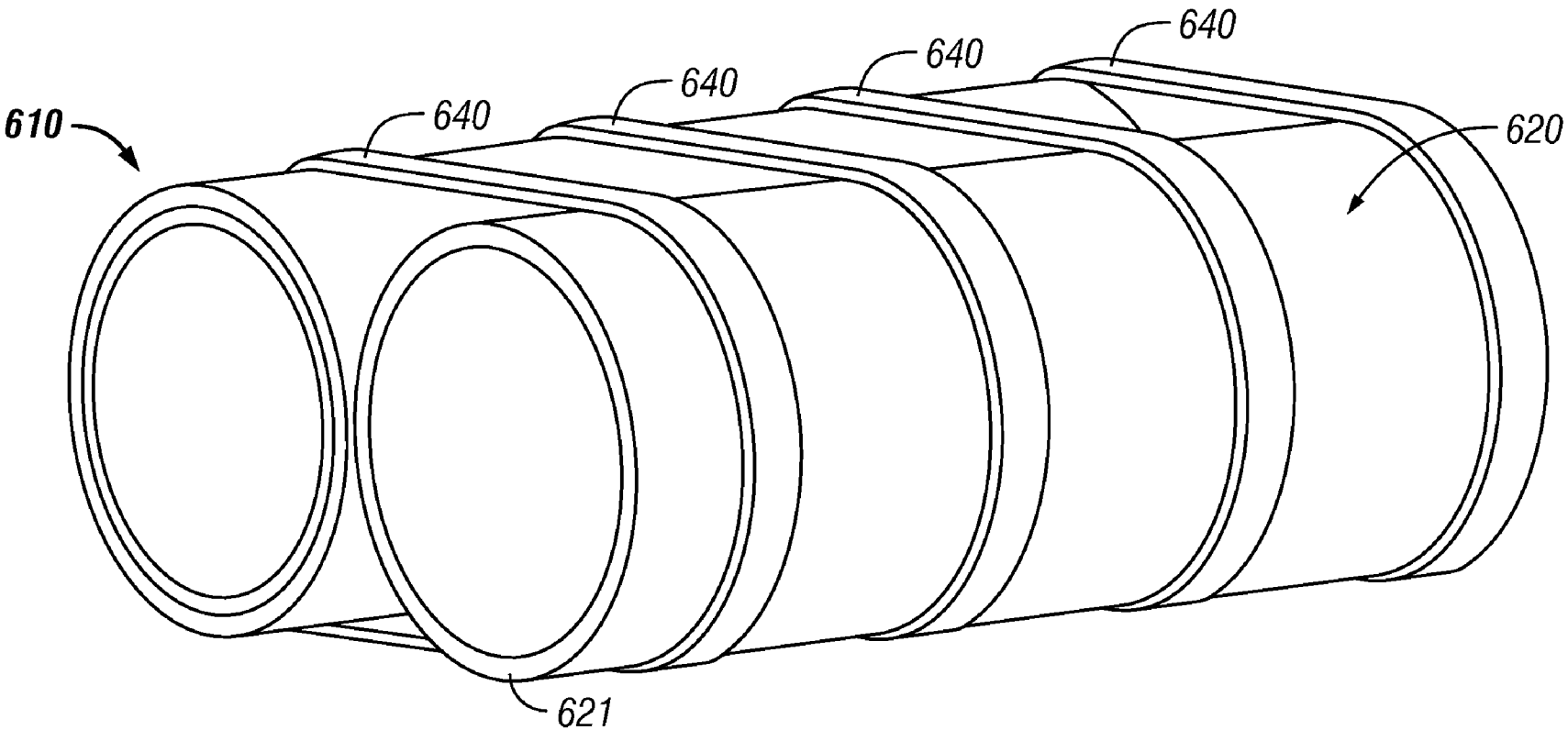
FIGS. 23 and 24 show additional embodiments of a side by side coiled tubing.

FIG. 23 illustrates an embodiment of a side by side dual coiled tubing such as one shown in U.S. Pat. No. 6,663,453 to Quigley, wherein a containment layer 621 of a continuous buoyancy control system 620 is discretely attached to the tube 610 through the use of a plurality of straps 640. In addition to the illustrated straps 640, other types of fasteners may also be employed, including, but not limited to, banding, taping, clamping, discrete bonding, and other mechanical and/or chemical attachment mechanisms known in the art. The containment layer 621 of the continuous buoyancy control system 620 may also have a corrugated outer surface to inhibit the discrete fastener 640, such as the bands or straps, from dislodging during the installation process. For example, the containment layer 621 may have a corrugated outer surface having a plurality of alternating peaks and valleys that are oriented circumferentially, for example, at approximately 90 degrees relative to the longitudinal axis of the containment layer 621. The straps 640 may be positioned within the valleys of the corrugated surface to inhibit dislodging of the straps 640.

Figure 24:
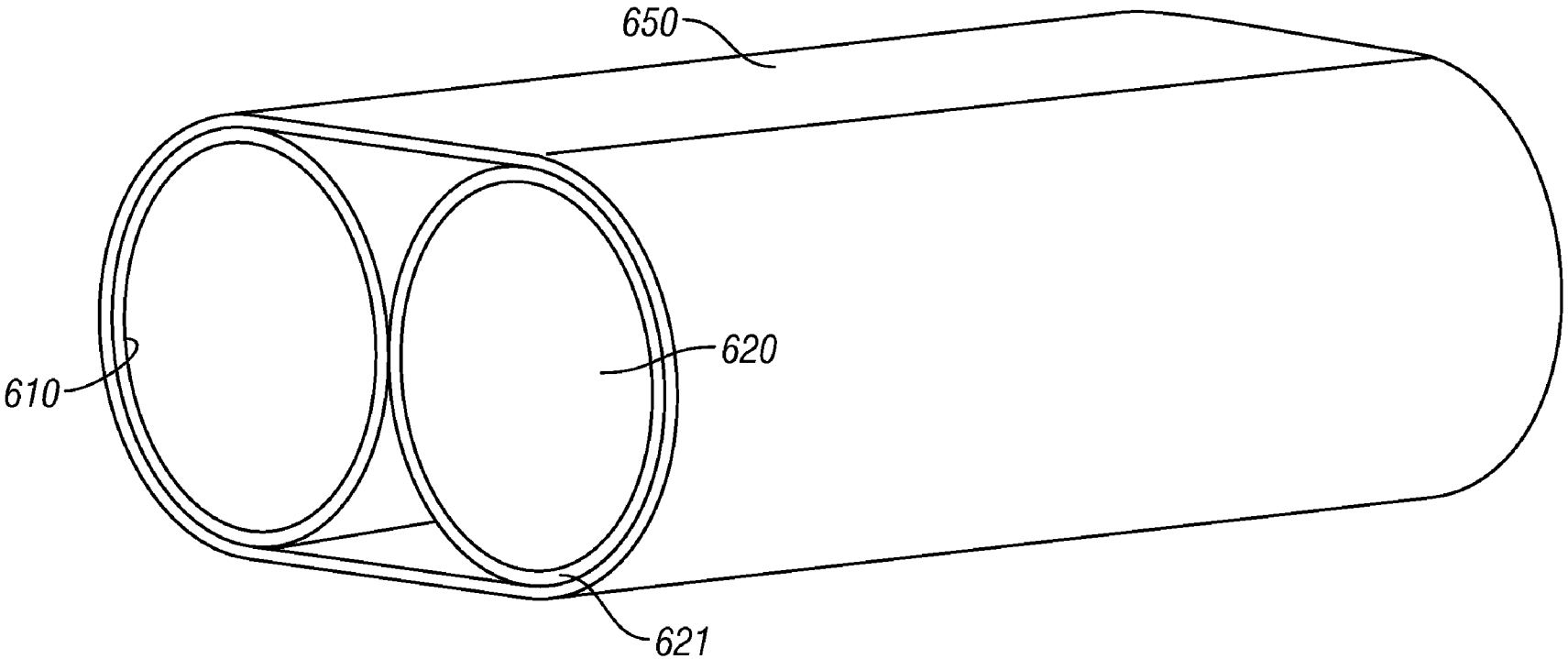

Referring to FIG. 24, the containment layer 621 of the buoyancy control system 620 may also be continuously affixed to the tube 610 by an outer jacket 650 that encapsulates the tube 610 and the containment layer 621 of the buoyancy control system 20. In the illustrated exemplary embodiment, the outer jacket 650 is a continuous tube having a generally oval cross-section that is sized and shaped to accommodate the tube 10 and the buoyancy control system 620. Those skilled in the art will appreciate that other cross sections, including circular, may be used and that the outer jacket 650 may be made in discrete interconnected segments. The outer jacket 650 may extend along the entire length of the tube 610 or the buoyancy system 620 or may be disposed along discrete segments of the tube 610 and the buoyancy control system 620. The outer jacket 650 may also be spoolable.

The outer jacket 650 may be a separately constructed tubular or other structure that is attached to the tube 610 and the system 620 during installation of the tube 610 and the system 620. Alternatively, the outer jacket 650 may be attached during manufacturing of the tube 610 and/or the system 620. The outer jacket 650 may be formed by continuous taping, discrete or continuous bonding, winding, extrusion, coating processes, and other known encapsulation techniques, including processes used to manufacture fiber-reinforced composites. The outer jacket 650 may be constructed from polymers, metals, composite materials, and materials generally used in the manufacture of polymer, metal, and composite tubing. Exemplary materials include thermoplastics, thermoset materials, fiber-reinforced polymers, PE, PET, urethanes, elastomers, nylon, polypropylene, and fiberglass Fluid transport, and tool assembly and transport using tubing such as explained with reference to FIGS. 21, 22, 23, and 24 may be according to one or more of the previously described embodiments for a single coiled tubing or coaxial dual coiled tubing.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for inserting a tool into a wellbore, comprising:

extending a coiled tubing into the wellbore;

at a first selected position along the coiled tubing, uncoupling the coiled tubing to expose an interior thereof;

inserting the tool into the interior of the coiled tubing, the tool held in place by a latch;

reconnecting the coiled tubing;

releasing the latch; and moving the tool along the interior of the tubing to a second selected position.

2. The method of claim 1 further comprising:

releasing a closure device proximate a lower end of the coiled tubing; and moving at least a portion of the tool into the wellbore below the lower end of the coiled tubing.

3. The method of claim 2 further comprising holding the tool in position with respect to the coiled tubing and withdrawing the coiled tubing from the wellbore.

4. The method of claim 3 further comprising measuring at least one parameter using a sensor in the tool.

5. The method of claim 4 further her comprising at least one of recording the measured parameter in a storage device associated with the tool and communicating the measured parameter to the Earth's surface substantially contemporaneously with the measuring.

6. The method of claim 5 wherein the communicating comprises at least one of transmitting an electromagnetic signal, transmitting an electrical signal, transmitting an acoustic signal and modulating a pressure of fluid pumped into the wellbore.

7. The method of claim 1 further comprising measuring at least one parameter using a sensor in the tool while extending the coiled tubing into the wellbore.

8. The method of claim 7 further comprising at least one of recording the measured parameter in a storage device associated with the tool and communicating the measured parameter to the Earth's surface substantially contemporaneously with the measuring.

9. The method of claim 1 further comprising:

extending a depth of the wellbore by drilling thereof and substantially contemporaneously measuring at least one parameter using a sensor in the tool.

10. The method of claim 9 wherein the at least one parameter comprises a property of Earth formations penetrated by the wellbore.

11. The method of claim 1 wherein the moving the tool along the interior of the tubing is performed by pumping fluid into the interior of the coiled tubing.

12. The method of claim 1 wherein the extending beyond the end of the coiled tubing comprises at least one of opening a passageway through a drill bit, opening a passageway through a drilling motor and detaching at least part of a bottom hole assembly from a bottom end of the tubing string.

13. The method of claim 1 further comprising measuring at least one parameter in a part of the wellbore beyond the end of the tubing using a sensor in the tool while withdrawing the coiled tubing.

14. The method of claim 1 further comprising measuring at least one parameter with a sensor in the tool during the moving beyond the end of the coiled tubing.

15. The method of claim 14 further comprising operating a drilling assembly at the end of the tool and drilling the wellbore below the end of the tool while measuring the at least one parameter.

16. The method of claim 1 further comprising:

moving the tool to a selected position along the interior of the tubing;

uncoupling the tubing at the selected position;

withdrawing the tool from the interior of the tubing; and reconnecting the tubing.

17. The method of claim 1 further comprising, prior to uncoupling the tubing, operating a drilling motor having a drill bit operatively coupled thereto, and extending the tubing into the wellbore to extend the wellbore through subsurface formations.

18. The method of claim 1 further comprising measuring at least one parameter with a sensor in the tool as the tool is moved along the interior of the tubing.

19. The method of claim 1 further comprising communicating a signal from the Earth's surface to the tool when the tool is disposed in the wellbore.

20. A method for operating a tool assembly in a multiple conduit coiled tubing, comprising:

extending the multiple conduit coiled tubing to a selected depth in a wellbore;

at a first selected position along the coiled tubing, uncoupling the multiple conduit coiled tubing to expose an interior thereof inserting the tool assembly into a first conduit of the coiled tubing, the tool assembly fixed in place at the first selected position by a latch;

reconnecting the coiled tubing;

releasing the latch; and moving the tool assembly along the interior of the tubing to a second selected position.

21. The method of claim 20 further comprising operating a drilling motor at a lower end of the coiled tubing, and drilling the wellbore by extending the tubing into the wellbore while operating the drilling motor.

22. The method of claim 21 further comprising measuring at least one parameter from a sensor in the tool assembly while drilling the wellbore.

23. The method of claim 20 further comprising:

releasing a closure device proximate a lower end of the coiled tubing; and moving at least a portion of the tool assembly into the wellbore below the lower end of the coiled tubing.

24. The method of claim 23 further comprising holding the tool assembly in position with respect to the coiled tubing and withdrawing the coiled tubing from the wellbore.

25. The method of claim 24 further comprising measuring at least one parameter using a sensor in the tool assembly while withdrawing the coiled tubing.

26. The method of claim 25 further comprising at least one of recording the measured parameter in a storage device associated with the tool assembly and communicating the measured parameter to the Earth's surface substantially contemporaneously with the measuring.

27. The method of claim 25 further comprising communicating a parameter from the Earth's surface to the tool assembly substantially contemporaneously with the measuring.

28. The method of claim 27 wherein the communicating comprises at least one of transmitting an electromagnetic signal, transmitting an acoustic signal, an electrical signal and modulating a pressure of fluid pumped into the wellbore.

29. The method of claim 20 wherein the moving the tool assembly is performed by pumping fluid into the interior of the coiled tubing.

30. The method of claim 20 further comprising moving the tool assembly by extending at least part of the tool assembly beyond an end of the coiled tubing in the wellbore.

31. The method of claim 30 wherein the moving beyond the end of the coiled tubing comprises at least one of opening a passageway through a drill bit, opening a passageway through a drilling motor and detaching at least part of a bottom hole assembly from a bottom end of the tubing string.

32. The method of claim 30 further comprising measuring at least one parameter in a part of the wellbore beyond the end of the tubing using a sensor in the tool assembly while withdrawing the coiled tubing.

33. The method of claim 20 further comprising transmitting at least one of electrical and hydraulic power along a conductor in at least one conduit in the coiled tubing, operating a drilling motor at a lower end of the coiled tubing using the power, and drilling the wellbore by extending the tubing into the wellbore while operating the drilling motor.

34. The method of claim 20 further comprising communicating a signal from the Earth's surface to the tool assembly when the tool assembly is disposed in the wellbore.

35. The method of claim 1 wherein the latch is released by at least one of applying fluid pressure to the tubing, pigging the tubing, and applying a signal to an exterior of the tubing proximate the latch.

36. The method of claim 1 wherein the second selected position results in the tool extending at least partially outward from a lowermost end of the tubing in the wellbore.

* * * * *